US009879405B2

(12) United States Patent
Saitoh et al.

(10) Patent No.: US 9,879,405 B2
(45) Date of Patent: Jan. 30, 2018

(54) HYDRAULIC DRIVING SYSTEM

(71) Applicant: Hitachi Construction Machinery Co., Ltd., Bunkyo-ku, Tokyo (JP)

(72) Inventors: Teppei Saitoh, Tokyo (JP); Juri Shimizu, Tokyo (JP); Mariko Mizuochi, Tokyo (JP); Kenji Hiraku, Tsuchiura (JP); Akinori Ishii, Tsuchiura (JP); Hiromasa Takahashi, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 366 days.

(21) Appl. No.: 14/661,629

(22) Filed: Mar. 18, 2015

(65) Prior Publication Data

US 2015/0292526 A1 Oct. 15, 2015

(30) Foreign Application Priority Data

Apr. 14, 2014 (JP) ..... 2014-082954

(51) Int. Cl.

| | |
|---|---|
| ***E02F 9/22*** | (2006.01) |
| ***F15B 11/17*** | (2006.01) |
| *F15B 7/00* | (2006.01) |

(52) U.S. Cl.

CPC ..... *E02F 9/2289* (2013.01); *E02F 9/2203* (2013.01); *E02F 9/2225* (2013.01); *E02F 9/2235* (2013.01); *E02F 9/2239* (2013.01); *E02F 9/2285* (2013.01); *E02F 9/2292* (2013.01); *E02F 9/2296* (2013.01);
(Continued)

(58) Field of Classification Search

CPC ..... F15B 11/17; F15B 7/006; F15B 2211/20561; F15B 2211/20576; F15B 2211/27; F15B 2211/31535; F15B 2211/41581; F15B 2211/45;
(Continued)

(56) References Cited

U.S. PATENT DOCUMENTS 7,191,593 B1 * 3/2007 Ho ..... B64C 13/50 244/78.1
7,234,298 B2 * 6/2007 Brinkman ..... E02F 9/2217 60/414
(Continued)

FOREIGN PATENT DOCUMENTS

WO WO 2005/024246 A1 3/2005

*Primary Examiner* — Logan Kraft
*Assistant Examiner* — Michael Quandt
(74) *Attorney, Agent, or Firm* — Crowell & Moring LLP

(57) ABSTRACT

To provide a hydraulic driving device configured to smoothly extend a hydraulic cylinder. The present invention includes the open circuit E, the closed circuit A, a control device 57, and a control lever 56*a*. The open circuit E is provided with a flow passage 202 for connecting an outlet port of the open circuit pump 13 and a head chamber 1*a* of the boom cylinder 1, a selector valve 44*a* provided in the flow passage 202, a discharge flow passage 404 for connecting a hydraulic fluid tank 25 and a flow passage 200, and a bleed-off valve 64 provided in the discharge flow passage 404. The control device 57 is configured in such a manner that when a manipulate signal for extending the boom cylinder 1 is input from the control lever 56*a*, the bleed-off valve 64 is closed, the selector valve 44*a* is subsequently opened, and the open circuit pump 13 is controlled.

4 Claims, 10 Drawing Sheets

(52) U.S. Cl.
CPC ..... *F15B 11/17* (2013.01); *F15B 7/006* (2013.01); *F15B 2211/20546* (2013.01); *F15B 2211/20561* (2013.01); *F15B 2211/20576* (2013.01); *F15B 2211/27* (2013.01); *F15B 2211/31535* (2013.01); *F15B 2211/40515* (2013.01); *F15B 2211/41581* (2013.01); *F15B 2211/46* (2013.01); *F15B 2211/613* (2013.01); *F15B 2211/6346* (2013.01); *F15B 2211/785* (2013.01)

(58) Field of Classification Search
CPC ..... F15B 2211/46; F15B 2211/613; F15B 2211/785; E02F 9/2289; E02F 9/2239; E02F 9/2292
USPC ..... 60/475, 476
See application file for complete search history.

(56) References Cited

U.S. PATENT DOCUMENTS

| | | | | |
|---|---|---|---|---|
| 8,893,490 | B2 * | 11/2014 | Knussman | E02F 9/2242 60/421 |
| 2015/0013320 | A1 * | 1/2015 | Akiyama | F15B 11/08 60/429 |
| 2016/0076558 | A1 * | 3/2016 | Gomm | F15B 7/006 60/327 |

* cited by examiner

INPUT SIGNAL OF CONTROL LEVER 56a
STOP
LIFTING OF BOOM
STOP
t

BLEED-OFF VALVE 64
64b
64a
OPEN POSITION
CLOSED POSITION
OPEN POSITION
t

SELECTOR VALVE 44a
44a2
44a1
CLOSED POSITION
OPEN POSITION
CLOSED POSITION
t

DISCHARGE FLOW RATE FROM CLOSED CIRCUIT PUMP 12
Qcp1
0
t

DISCHARGE FLOW RATE FROM OPEN CIRCUIT PUMP 13
Qop1
MINIMUM DISCHARGE FLOW RATE
0
t
dT1

INPUT SIGNAL OF CONTROL LEVER 56a
STOP
LOWERING OF BOOM
STOP
t

BLEED-OFF VALVE 64
64b
64a
OPEN POSITION
CLOSED POSITION
OPEN POSITION
t

SELECTOR VALVE 44a
44a2
44a1
CLOSED POSITION
OPEN POSITION
CLOSED POSITION
t

DISCHARGE FLOW RATE FROM CLOSED CIRCUIT PUMP 12
0
−Qcp1
t

DISCHARGE FLOW RATE FROM OPEN CIRCUIT PUMP 13
MINIMUM DISCHARGE FLOW RATE
0
t
dT2

CASE WHERE THERE IS NO EXTENSION CONTROL TIMING dT1

CASE WHERE CONTROL IS PERFORMED WITH EXTENSION CONTROL TIMING dT1

CASE WHERE THERE IS NO RETRACTION CONTROL TIMING dT2

CASE WHERE CONTROL IS PERFORMED WITH RETRACTION CONTROL TIMING dT2

HYDRAULIC DRIVING SYSTEM

BACKGROUND

1. Field of the Invention

The present invention relates to a hydraulic driving system for driving, for example, an operating machine such as a hydraulic excavator, and especially relates to a hydraulic driving system having a closed circuit with a single rod hydraulic cylinder and a hydraulic fluid inlet-flow and outlet-flow control unit for the closed circuit annularly connected to each other.

2. Description of the Related Art

Recently, in an operating machine such as a hydraulic excavator, a hydraulic circuit referred to as the so-called closed circuit has been known. The closed circuit is configured to be connected annularly (in a closed circuit-shaped manner) so that hydraulic fluid is directly fed to a single rod hydraulic cylinder as a hydraulic actuator from a hydraulic pump as a pressure generation source, and the hydraulic fluid after driving the single rod hydraulic cylinder and performing a predetermined work is directly returned to the single rod hydraulic cylinder. On the other hand, in contrast to the closed circuit, a hydraulic circuit referred to as the so-called open circuit has been also known. The open circuit is configured in such a manner that the hydraulic fluid is fed from the hydraulic pump to the single rod hydraulic cylinder through a throttle by a control valve, and the hydraulic fluid (return hydraulic oil) led to flow out of the single rod hydraulic cylinder is discharged to a hydraulic fluid tank. In comparison with the hydraulic circuit employing an open circuit method, the hydraulic circuit employing a closed circuit method is excellent in fuel economy performance because there is a little pressure loss caused by the throttle and energy of the return hydraulic fluid from the single rod hydraulic cylinder is regenerated by the hydraulic pump.

International Publication WO 2005/024246 discloses a related art with these kinds of closed circuits combined with each other. In International Publication WO 2005/024246, a first closed circuit with the hydraulic pump connected in a closed circuit-shaped manner is installed with respect to a boom cylinder as the single rod hydraulic cylinder, and also a second closed circuit with a hydraulic pump connected in a closed circuit-shaped manner is installed with respect to an arm cylinder. Further, an open circuit with a hydraulic pump connected through a control valve is installed with respect to a bucket cylinder. A distribution circuit is divergingly provided in order to distribute the hydraulic fluid delivered from the hydraulic pump of the open circuit, from a side of the hydraulic pump provided closer to the control valve of the open circuit to the boom cylinder and the arm cylinder. A check valve for preventing a backward flow of the hydraulic fluid from the closed circuit to the open circuit is provided in the distribution circuit.

In the related art disclosed in the above-described International Publication WO 2005/024246, the hydraulic pump of the closed circuit and the hydraulic pump of the open circuit are respectively driven, and the backward flow of the hydraulic fluid from the open circuit to the closed circuit, caused when, for example, the boom cylinder is extended, is prevented by the check valve. However, if there is a pressure difference between a side of the open circuit and a side of the closed circuit, there is a possibility that smooth motion of the boom cylinder may be impaired because an inlet-flow rate of the hydraulic fluid into the boom cylinder is suddenly changed when the hydraulic fluid on the side of the open circuit and the hydraulic fluid of the side of the closed circuit are merged by the distribution circuit and are fed to the boom cylinder.

SUMMARY

The present invention has been achieved under the above-mentioned circumstances in the related art, and an object of the present invention is to provide a hydraulic driving system capable of smoothly extending a single rod hydraulic cylinder.

In order to achieve the above-mentioned object, according to a first aspect of the present invention, there is provided a hydraulic driving system including: a closed circuit that is provided with at least one hydraulic fluid inlet-flow and outlet-flow control unit for a closed circuit, the control unit having two inlet and outlet ports allowing inlet-flow and outlet-flow hydraulic fluid in both directions, and a single rod hydraulic cylinder having a piston, a head chamber with the hydraulic fluid introduced thereto during extension of the piston, and a rod chamber with the hydraulic fluid introduced thereto during retraction of the piston, the closed circuit being configured in such a manner that the two inlet and outlet ports of the hydraulic fluid inlet-flow and outlet-flow control unit for the closed circuit are annularly connected to the head chamber and the rod chamber; an open circuit that is provided with at least one hydraulic fluid inlet-flow and outlet-flow control unit for an open circuit, the control unit having an inlet port for allowing the hydraulic fluid to flow into from a hydraulic fluid tank and an outlet port for allowing the hydraulic fluid to flow out of the hydraulic fluid tank, a first flow passage for connecting the outlet port of the hydraulic fluid inlet-flow and outlet-flow control unit for the open circuit and the head chamber of the single rod hydraulic cylinder, a first opening and closing device provided in the first flow passage, a second flow passage connected to the first flow passage and returning the hydraulic fluid led to flow out of the outlet port of the hydraulic fluid inlet-flow and outlet-flow control unit for the open circuit to the hydraulic fluid tank, and a second opening and closing device provided in the second flow passage; a control device that controls the hydraulic fluid inlet-flow and outlet-flow control unit for the closed circuit, the hydraulic fluid inlet-flow and outlet-flow control unit for the open circuit, and the first and second opening and closing devices; and a manual operating device that manipulates the extension and retraction of the single rod hydraulic cylinder and that outputs a manipulate signal corresponding to manipulation to the control device. The control device is configured in such a manner that when the manipulate signal for extending the single rod hydraulic cylinder is input from the manual operating device, the second opening and closing device is closed, the first opening and closing device is subsequently opened, and the hydraulic fluid inlet-flow and outlet-flow control unit for the open circuit is controlled.

With the first feature of the present invention, when the manipulate signal for extending the single rod hydraulic cylinder is input from the manual operating device, the second opening and closing device is closed, and the first opening and closing device is subsequently opened. The second opening and closing device is provided in the second flow passage in order to return the hydraulic fluid led to flow out of the outlet port of the hydraulic fluid inlet-flow and outlet-flow control unit for the open circuit to the hydraulic fluid tank, and the first opening and closing device is provided in the first flow passage for connecting the outlet port of the hydraulic fluid inlet-flow and outlet-flow control unit for the open circuit and the head chamber of the single rod hydraulic cylinder. That is, with return of the hydraulic fluid from the second flow passage to the hydraulic fluid tank shut down, pressure of the hydraulic fluid led to flow out of the outlet port of the hydraulic fluid inlet-flow and outlet-flow control unit for the open circuit is increased in the first flow passage, and the hydraulic fluid is subsequently fed to the head chamber of the single rod hydraulic cylinder. As a result, with a pressure difference between the hydraulic fluid pressure on the side of the open circuit and the hydraulic fluid pressure on the side of the closed circuit reduced, the hydraulic fluid inlet-flow and outlet-flow control unit for the open circuit is controlled, and the hydraulic fluid led to flow out of the hydraulic fluid inlet-flow and outlet-flow control unit for the open circuit and the hydraulic fluid inlet-flow and outlet-flow control unit for the closed circuit is smoothly fed to the head camber of the single rod hydraulic cylinder. Now, therefore, the single rod hydraulic cylinder is smoothly extended, and operability is improved.

According to a second aspect of the present invention, the control device is configured in such a manner that when the manipulate signal for retracting the single rod hydraulic cylinder is input from the manual operating device, the first and second opening and closing devices are respectively opened, and the hydraulic fluid inlet-flow and outlet-flow control unit for the closed circuit is subsequently controlled.

With the second feature of the present invention, when the manipulate signal for retracting the single rod hydraulic cylinder is input from the manual operating device, the first opening and closing device and the second opening and closing device are respectively opened, and the hydraulic fluid inlet-flow and outlet-flow control unit for the closed circuit is subsequently controlled. Thereby, an excess flow rate of the hydraulic fluid led to flow out of the head chamber of the single rod hydraulic cylinder is discharged to the hydraulic fluid tank through the first flow passage. For this reason, the retracting of the single rod hydraulic cylinder is speeded up.

According to a third aspect of the present invention, the first opening and closing device is opened when pressure of the hydraulic fluid upstream of the first opening and closing device is higher than pressure of the hydraulic fluid introduced into the head chamber of the single rod hydraulic cylinder.

With the third feature of the present invention, when the manipulate signal for extending the single rod hydraulic cylinder is input from the manual operating device, the second opening and closing device is closed. After that, when the pressure of the hydraulic fluid upstream of the first opening and closing device becomes higher than the pressure of the hydraulic fluid introduced into the head chamber of the single rod hydraulic cylinder, the first opening and closing device is opened, and the hydraulic fluid upstream of the first opening and closing device is fed to the head chamber of the single rod hydraulic cylinder. In this state, the hydraulic fluid inlet-flow and outlet-flow control unit for the open circuit is controlled. That is, the return of the hydraulic fluid from the second flow passage to the hydraulic fluid tank is shut down, and the hydraulic fluid led to flow out of the outlet port of the hydraulic fluid inlet-flow and outlet-flow control unit for the open circuit is increased in the first flow passage and is subsequently fed to the head chamber of the single rod hydraulic cylinder. As a result, with the pressure difference between the hydraulic fluid pressure on the side of the open circuit and the hydraulic fluid pressure on the side of the closed circuit reduced, the hydraulic fluid inlet-flow and outlet-flow control unit for the open circuit is controlled, and the hydraulic fluid led to flow out of the hydraulic fluid inlet-flow and outlet-flow control unit for the open circuit and the hydraulic fluid inlet-flow and outlet-flow control unit for the closed circuit is smoothly fed to the head chamber of the single rod hydraulic cylinder. Now, therefore, the single rod hydraulic cylinder is smoothly extended, and the operability is improved.

According to a fourth aspect of the present invention, the control device is configured in such a manner that when the manipulate signal for retracting the single rod hydraulic cylinder is input from the manual operating device, the second opening and closing device is closed, and after the pressure of the hydraulic fluid in the first flow passage exceeds a predetermined value, the first and second opening and closing devices are respectively opened.

With the fourth feature of the present invention, when the manipulate signal for retracting the single rod hydraulic cylinder is input from the manual operating device, the second opening and closing device is closed, and after the pressure of the hydraulic fluid in the first flow passage exceeds the predetermined value, the first and second opening and closing devices are respectively opened. And then, the hydraulic fluid inlet-flow and outlet-flow control unit for the closed circuit is controlled. That is, by shutting down the return of the hydraulic fluid from the second flow passage to the hydraulic fluid tank, the hydraulic fluid pressure in the first flow passage is increased by the hydraulic fluid delivered from the hydraulic fluid inlet-flow and outlet-flow control unit for the closed circuit, and the pressure difference between the hydraulic fluid pressure in the first flow passage and the hydraulic fluid pressure in the head chamber of the single rod hydraulic cylinder is reduced. In this state, connection to the first flow passage is performed through the first opening and closing device, and further, connection to the hydraulic fluid tank is performed through the second opening and closing device. Consequently, a sudden flow of the hydraulic fluid in the first flow passage and the second flow passage during connection is prevented. The sudden flow is caused by the pressure difference when the hydraulic fluid led to out of the head chamber of the single rod hydraulic cylinder is merged with the hydraulic fluid on the side of the open circuit through the first flow passage, and the temporary retraction of the single rod hydraulic cylinder is eliminated. For this reason, the single rod hydraulic cylinder is smoothly retracted.

According to a fifth aspect of the present invention, the hydraulic driving system further includes a pressure sensing system for detecting the pressure of the hydraulic fluid in the first flow passage. The control device is configured in such a manner that the hydraulic fluid inlet-flow and outlet-flow control unit for the closed circuit, the hydraulic fluid inlet-flow and outlet-flow control unit for the open circuit, and the first and second opening and closing devices are controlled based on the pressure of the hydraulic fluid in the first flow passage detected by the pressure sensing system.

With the fifth feature of the present invention, the control device is configured in such a manner that the hydraulic fluid inlet-flow and outlet-flow control unit for the closed circuit, the hydraulic fluid inlet-flow and outlet-flow control unit for the open circuit, and the first and second opening and closing devices are controlled based on the pressure of the hydraulic fluid in the first flow passage detected by the pressure sensing system. For this reason, driving of the hydraulic fluid inlet-flow and outlet-flow control unit for the closed circuit, the hydraulic fluid inlet-flow and outlet-flow control unit for the open circuit, the first opening and closing device, and the second opening and closing device is more properly controlled by the control device, and the motion of the single rod hydraulic cylinder is further smoothened.

The present invention is has such a structure when a manipulate signal for extending a single rod hydraulic cylinder is input from a manual operating device, a second opening and closing device is closed, and a first opening and closing device is subsequently opened. With this structure, in the present invention, with return of hydraulic fluid from a second flow passage to a hydraulic fluid tank shut down, pressure of the hydraulic fluid led to flow out of an outlet port of a hydraulic fluid inlet-flow and outlet-flow control unit for an open circuit is increased in the first flow passage, and the hydraulic fluid is subsequently fed to a head chamber of the single rod hydraulic cylinder. As a result, with a pressure difference between hydraulic fluid pressure on a side of an open circuit and hydraulic fluid pressure on a side of a closed circuit reduced, the hydraulic fluid inlet-flow and outlet-flow control unit for the open circuit is controlled, and the hydraulic fluid led to flow out of the hydraulic fluid inlet-flow and outlet-flow control unit for the open circuit and the hydraulic fluid inlet-flow and outlet-flow control unit for the closed circuit is smoothly fed to the head chamber of the single rod hydraulic cylinder. For this reason, the single rod hydraulic cylinder is smoothly extended. Further, problems, structures and effects except for those as have been described above will be obvious from the following description of embodiments.

BRIEF DESCRIPTION OF THE DRAWINGS

Non-limiting and non-exhaustive embodiments of the present embodiments are described with reference to the following FIGURES, wherein like reference signs refer to like parts throughout the various views unless otherwise specified.

FIG. 4A to FIG. 4E are time charts showing a state when a boom of the hydraulic driving system is lifted, wherein FIG. 4A is indicative of an input signal of a control lever 56*a*, FIG. 4B is indicative of a state of a bleed-off valve 64, FIG. 4C is indicative of a state of a selector valve 44*a*, FIG. 4D is indicative of a discharge flow rate from a closed circuit pump 12, and FIG. 4E is indicative of a discharge flow rate from an open circuit pump 13.

FIG. 5A to FIG. 5E are time charts showing a state when the boom of the hydraulic driving system is lowered, wherein FIG. 5A is indicative of the input signal of the control lever 56*a*, FIG. 5B is indicative of the state of the bleed-off valve 64, FIG. 5C is indicative of the state of the selector valve 44*a*, FIG. 5D is indicative of the discharge flow rate from the closed circuit pump 12, and FIG. 5E is indicative of the discharge flow rate from the open circuit pump 13.

FIG. 6A and FIG. 6B are graphs showing a time-series response of pressure in a first flow passage when the boom of the hydraulic driving system is lifted, wherein FIG. 6A is indicative of the case where there is no extension control timing dT1, and FIG. 6B is indicative of the case where control is performed with the extension control timing dT1.

FIG. 7A and FIG. 7B are graphs showing a time-series response of pressure in the first flow passage when the boom of the hydraulic driving system is lowered, wherein FIG. 7A is indicative of the case where there is no retraction control timing dT2, and FIG. 7B is indicative of the case where control is performed with the retraction control timing dT2.

DETAILED DESCRIPTION

Hereinafter, preferred embodiments of the present invention will be described with reference to the accompanying drawings.

[First Embodiment]

Figure 1:
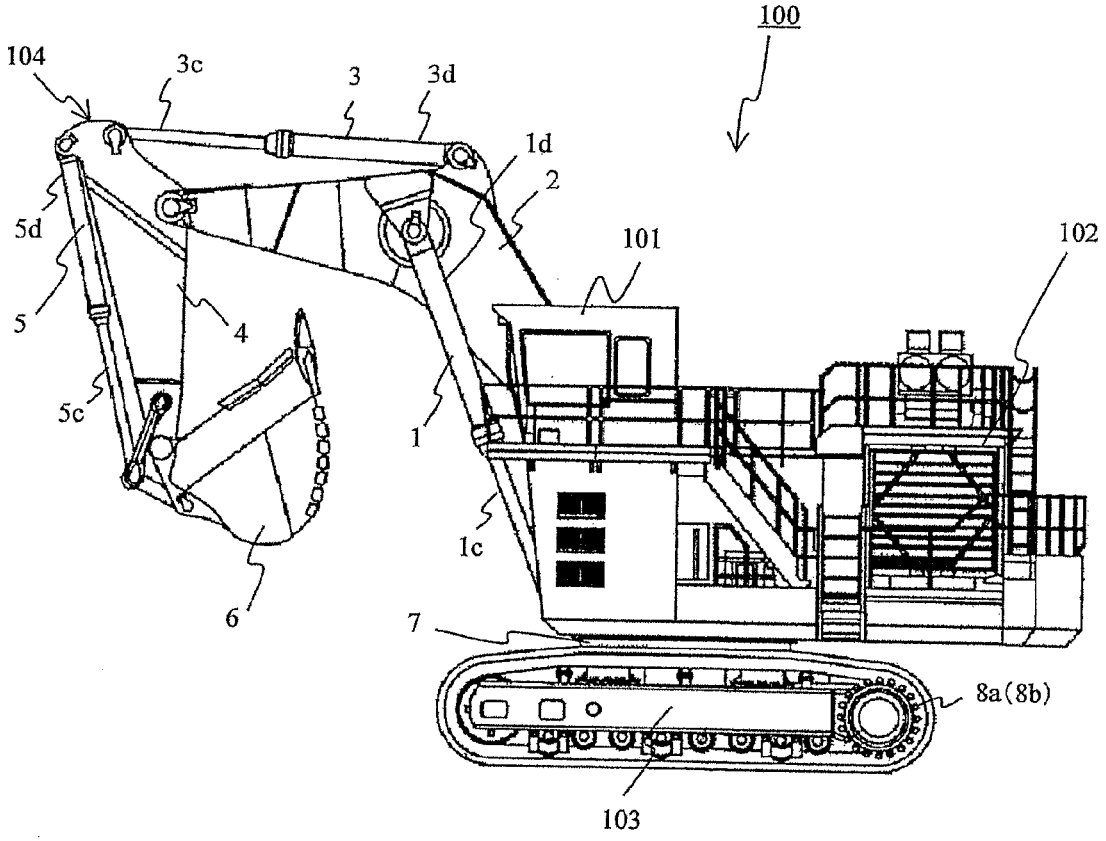
FIG. 1 is a schematic view showing a hydraulic excavator mounted with a hydraulic driving system according to a first embodiment of the present invention.
Figure 2:
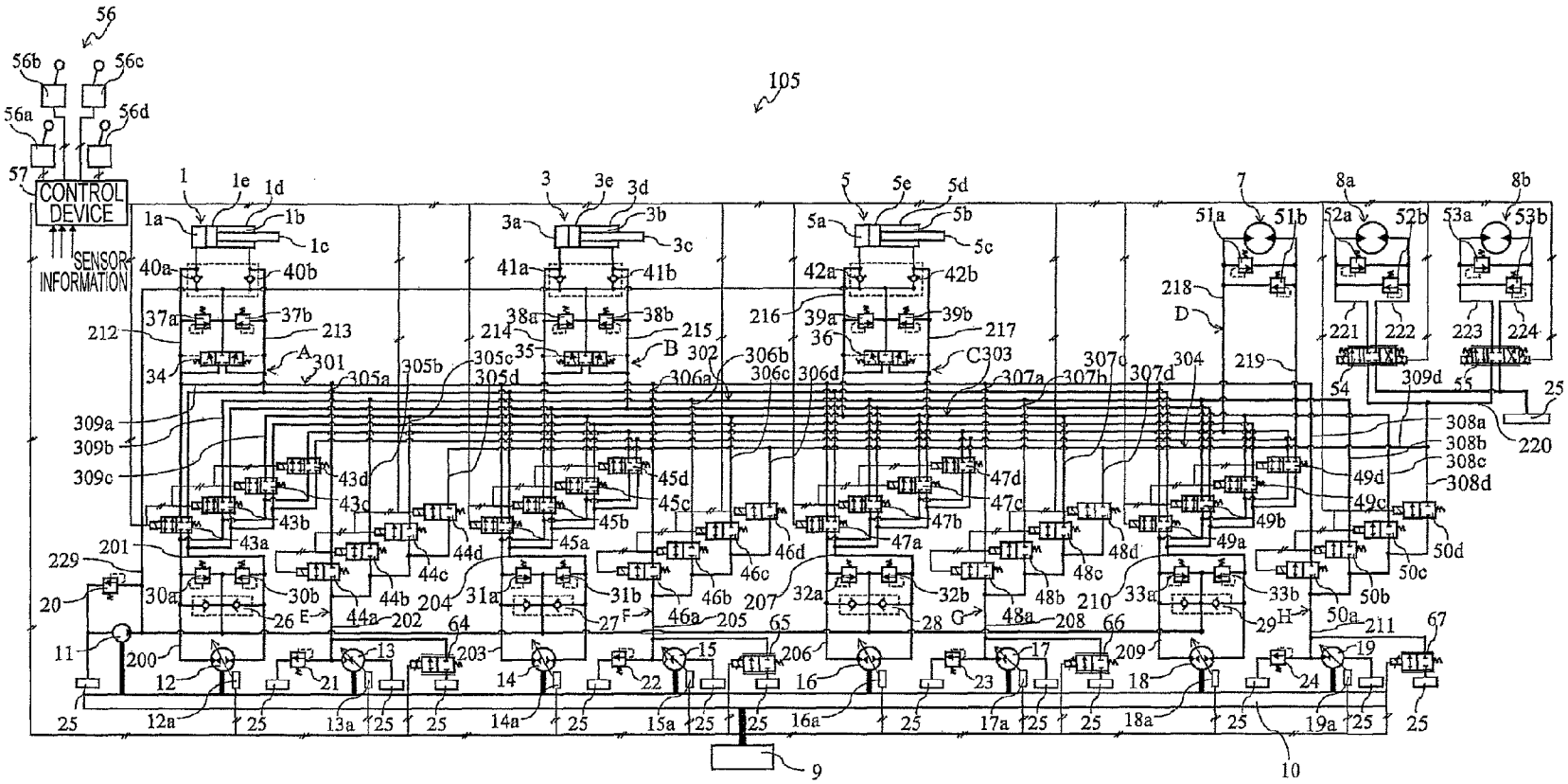
FIG. 2 is a hydraulic circuit diagram showing a system structure of the hydraulic driving system.

FIG. 1 is a schematic view showing a hydraulic excavator mounted with a hydraulic driving system according to a first embodiment of the present invention. FIG. 2 is a hydraulic circuit diagram showing a system structure of the hydraulic driving system. In the first embodiment, when a single rod hydraulic cylinder is extended, in order to reduce a pressure difference between the front and rear of a selector valve provided on a flow passage merged with a closed circuit from an open circuit, timing for closing a discharge passage provided in the open circuit in order to discharge hydraulic fluid to a hydraulic fluid tank and timing for opening the selector valve provided on the flow passage to be merged are controlled. Thereby, a change in a hydraulic fluid flow rate with the hydraulic fluid merged into the closed circuit from the open circuit is suppressed, and sufficient starting characteristic of the single rod hydraulic cylinder is achieved. Also, at the same time, when the single rod hydraulic cylinder is retreated, the hydraulic fluid led to flow out of a side of a head chamber of the single rod hydraulic cylinder is branched into the closed circuit and the open circuit, the hydraulic fluid led to flow out of the side of the head chamber is rapidly led to flow out to the hydraulic fluid tank by an excess flow rate of the hydraulic fluid, and the retraction of the single rod hydraulic cylinder is speeded up.

<Entire Structure>

As an operating machine mounted with a hydraulic driving system 105 shown in FIG. 2 according to the first embodiment of the present invention, a hydraulic excavator 100 will be described by way of example. As shown in FIG. 1, the hydraulic excavator 100 includes a lower machinery 103 with crawler type travel devices 8*a*, 8*b* provided on both sides in a horizontal direction, and an upper machinery 102 as a body turnably installed on the lower machinery 103. A cab 101 on which an operator gets on is provided on the upper machinery 102. The lower machinery 103 and the upper machinery 102 are turned through a swing device 7.

A base end of a front working machine 104 as an actuator for performing, for example, excavation work, is turnably installed on a front side of the upper machinery 102. Note that the front side means a front direction (a left direction in FIG. 1) of the cab 101. The front working machine 104 is provided with a boom 2 having a base end coupled in an elevating manner to the front side of the upper machinery 102. The boom 2 operates through a boom cylinder 1 as a single rod hydraulic cylinder extended by feeding hydraulic fluid (pressurized oil). The boom cylinder 1 is provided with a rod 1*c* having an end coupled to the upper machinery 102, and a cylinder tube 1*d* having a base end coupled to the boom 2.

As shown in FIG. 2, the boom cylinder 1 is provided with a head chamber 1*a* that is positioned at the base end of the cylinder tube 1*d*, push-presses the piston 1*e* attached at the base end of the rod 1*c* by feeding the hydraulic fluid to apply a load by hydraulic fluid pressure, and thereby extends and moves the rod 1*c*. Also, the boom cylinder 1 is provided with a rod chamber 1*b* that is positioned at a tip end of the cylinder tube 1*d*, push-presses the piston 1*e* by feeding the hydraulic fluid to apply the load by the hydraulic fluid pressure, and thereby retracts and moves the rod 1*c*.

The base end of the arm 4 is coupled in an elevating manner to the tip end of the boom 2. The arm 4 operates through an arm cylinder 3 as the single rod hydraulic cylinder. The arm cylinder 3 is provided with a rod 3*c* having a tip end coupled to the arm 4, and a cylinder tube 3*d* coupled to the boom 2. As shown in FIG. 2, the arm cylinder 3 is provided with a head chamber 3*a* that is positioned at the base end of the cylinder tube 3*d*, push-presses the piston 3*e* attached at the base end of the rod 3*c* by feeding hydraulic fluid, and thereby extends and moves the rod 3*c*. Also, the arm cylinder 3 is provided with a rod chamber 3*b* that is positioned at the tip end of the cylinder tube 3*d*, push-presses the piston 3*e* by feeding the hydraulic fluid, and thereby retracts and moves the rod 3*c*.

A base end of a bucket 6 is coupled in an elevating manner to the tip end of the arm 4. The bucket 6 operates through a bucket cylinder 5 as the single rod hydraulic cylinder. The bucket cylinder 5 is provided with a rod 5*c* having a tip end coupled to the bucket 6, and a cylinder tube 5*d* having a base end coupled to the arm 4. The bucket cylinder 5 is provided with a head chamber 5*a* that is positioned at the base end of the cylinder tube 5*d*, push-presses a piston 5*e* attached at the base end of the rod 5*c* by feeding the hydraulic fluid, and thereby extends and moves the rod 5*c*. Also, the bucket cylinder 5 is provided with a rod chamber 5*b* that is positioned at the tip end of the cylinder tube 5*d*, push-presses the piston 5*e* by feeding the hydraulic fluid, and thereby retracts and moves the rod 5*c*.

Note that the boom cylinder 1, the arm cylinder 3, and the bucket cylinder 5 are respectively extended and retracted by the hydraulic fluid to be fed, and are driven to be extended and retracted dependently on a feeding direction of the hydraulic fluid to be fed. The hydraulic driving system 105 is used to drive the swing device 7 and the travel devices 8*a*, 8*b* in addition to the boom cylinder 1, the arm cylinder 3, and the bucket cylinder 5 that compose the front working machine 104. The swing device 7 and the travel devices 8*a*, 8*b* are hydraulic motors rotatively driven by being fed with the hydraulic fluid.

As shown in FIG. 2, the hydraulic driving system 105 drives the boom cylinder 1, the arm cylinder 3, the bucket cylinder 5, the swing device 7, and the travel devices 8*a*, 8*b* that are made to serve as hydraulic actuators according to manipulation of a control lever device 56 as an operating portion placed in the cab 101. The extension and retraction of the boom cylinder 1, the arm cylinder 3, and the bucket cylinder 5, that is, a motion direction and a motion speed thereof, are instructed by manipulation directions and manipulated variable of the respective control levers 56*a* to 56*d* of the control lever device 56.

The hydraulic driving system 105 includes an engine 9 as a power source. The engine 9 is connected to a power transmission device 10 that is composed of, for example, a predetermined gear and the like, and that is configured to distribute power. Variable displacement closed circuit pumps 12, 14, 16, 18, variable displacement open circuit pumps 13, 15, 17, 19, and a charge pump 11 that is configured to replenish the hydraulic fluid when the hydraulic fluid pressure of each of the closed circuits A to D is lowered and to ensure the hydraulic fluid pressure of each of the closed circuits A to D, are respectively connected to the power transmission device 10.

The closed circuit pumps 12, 14, 16, 18 are used for the closed circuits A to D described later, and are provided with bidirectionally tilting swash plate mechanisms (not shown) that deliver the hydraulic fluid in both directions from the need to change the delivering direction of the hydraulic fluid and to control driving of the corresponding hydraulic actuators. For this reason, the respective closed circuit pumps 12, 14, 16, 18 are provided with a pair of inlet and outlet ports that allow inlet-flow and outlet-flow of the hydraulic fluid in both directions. Also, the respective closed circuit pumps 12, 14, 16, 18 are provided with regulators 12*a*, 14*a*, 16*a*, 18*a* as flow rate regulation units for regulating a tilting angle (inclination angle) of each bidirectionally tilting swash plate composing each of the bidirectionally tilting swash plate mechanisms. On the other hand, since the open circuit pumps 13, 15, 17, 19 are used for open circuits E to H that control the feeding direction of the hydraulic fluid by selector valves 44*a* to 44*d*, 46*a* to 46*d*, 48*a* to 48*d*, and 50*a* to 50*d*, the hydraulic fluid has only to be delivered in one direction. For this reason, the open circuit pumps 13, 15, 17, 19 are provided with unidirectionally tilting swash plate mechanisms that deliver the hydraulic fluid in the one direction. Now, therefore, the respective open circuit pumps 13, 15, 17, 19 are provided with output ports as outlet-flow sides for the hydraulic fluid and input ports as inlet-flow sides for the hydraulic fluid. Also, the open circuit pumps 13, 15, 17, 19 are provided with regulators 13*a*, 15*a*, 17*a*, 19*a* as flow rate regulation units for regulating a tilting angle (inclination angle) of each unidirectionally tilting swash plate composing each of the unidirectionally tilting swash plate mechanisms. The open circuit pumps 13, 15, 17, 19 deliver the hydraulic fluid of a flow rate equal to or more than a predetermined rate (minimum discharge flow rate). The regulators 12*a* to 19*a* are flow rate control units that, according to a manipulate signal output from a control device 57 as a controller, regulate the tilting angle of the swash plates of the corresponding closed circuit pumps and open circuit pumps 12 to 19, and control the flow rate of the hydraulic fluid delivered from the closed circuit pumps and open circuit pumps 12 to 19. Note that the closed circuit pumps and open circuit pumps 12 to 19 may be variable tilting mechanism such as inclined mechanism, and do not stick to the swash plate mechanisms.

The closed circuit pumps 12, 14, 16, 18 are hydraulic pumps for the closed circuits, used as hydraulic fluid inlet-flow and outlet-flow control units for the closed circuits connected to the closed circuits A to D. The open circuit pumps 13, 15, 17, 19 are hydraulic pumps for open circuits, used as hydraulic fluid inlet-flow and outlet-flow control units for the open circuits connected to the open circuits E to H.

Specifically, one input and output port of the closed circuit pump 12 is connected to a flow passage 200, and the other input and output port thereof is connected to a flow passage 201. A plurality of selector valves, for example, four selector valves 43*a* to 43*d* are connected to the flow passages 200, 201. The selector valves 43*a* to 43*c* are made to serve as closed circuit switching units that switch feeding of the hydraulic fluid to the boom cylinder 1, the arm cylinder 3, and the bucket cylinder 5 that are connected in a closed circuit-shaped manner to the closed circuit pump 12 to thereby drive to extend and retract the required hydraulic actuator from among the boom cylinder 1, the arm cylinder 3, and the bucket cylinder 5. The selector valve 43*d* is made to serve as a closed circuit switching unit for a hydraulic motor, and is configured to switch the feeding of the hydraulic fluid to the swing device 7 connected in a closed circuit-shaped manner to the closed circuit pump 12 to thereby switch a swinging direction of the swing device 7. The selector valves 43*a* to 43*d* are configured to switch between conduction and disconnection of the flow passages 200, 201 according to the manipulate signal output from the control device 57, and are disconnected when the manipulate signal is not output from the control device 57. The control device 57 performs control so that the selector valves 43*a* to 43*d* are not to be made conductive at the same time.

The selector valve 43*a* is connected to the boom cylinder 1 through the flow passages 212, 213. The closed circuit pump 12 composes the closed circuit A that is connected in a closed circuit-shaped manner to the boom cylinder 1 through the flow passages 200, 201, the selector valve 43*a*, and the flow passages 212, 213 when the selector valve 43*a* is made conductive according to the manipulate signal output from the control device 57. The selector valve 43*b* is connected to the arm cylinder 3 through the flow passages 214, 215. The closed circuit pump 12 composes a closed circuit B that is connected in a closed circuit-shaped manner to the arm cylinder 3 through the flow passages 200, 201, the selector valve 43*b*, and the flow passages 214, 215 when the selector valve 43*b* is made conductive according to the manipulate signal output from the control device 57.

The selector valve 43*c* is connected to the bucket cylinder 5 through the flow passages 216, 217. The closed circuit pump 12 composes a closed circuit C that is connected in a closed circuit-shaped manner to the bucket cylinder 5 through the flow passages 200, 201, the selector valve 43*c*, and the flow passages 216, 217 when the selector valve 43*c* is made conductive according to the manipulate signal output from the control valve 57. The selector valve 43*d* is connected to the swing device 7 through the flow passages 218, 219. The closed circuit pump 12 composes a closed circuit D that is connected in a closed circuit-shaped manner to the swing device 7 through the flow passages 200, 201, the selector valve 43*d*, and the flow passages 218, 219 when the selector valve 43*d* is made conductive according to the manipulate signal output from the control device 57.

The flow passage 212 is made to serve as a connecting flow passage for the hydraulic cylinder, configured to independently connect the boom cylinder 1 to a plurality of selector valves 44*a*, 46*a*, 48*a*, 50*a* of the open circuits E to H described later. The flow passage 214 is made to serve as a connecting flow passage for the hydraulic cylinder, configured to independently connect the arm cylinder 3 to a plurality of selector valves 44*b*, 46*b*, 48*b*, 50*b* of the open circuits E to H described later. The flow passage 216 is made to serve as a connecting flow passage for the hydraulic cylinder, configured to independently connect the bucket cylinder 5 to a plurality of selector valves 44*c*, 46*c*, 48*c*, 50*c* of the open circuit passages E to H described later.

Also, a flow passage 203 is connected to one input and output port of the closed circuit pump 14, and a flow passage 204 is connected to the other input and output port thereof. A plurality of selector valves, for example, four selector valves 45*a* to 45*d* are connected to the flow passages 203, 204. The selector valves 45*a* to 45*c* are made to serve as closed circuit switching units that switch the feeding of the hydraulic fluid to the boom cylinder 1, the arm cylinder 3, and the bucket cylinder 5 that are connected in a closed circuit-shaped manner to the closed circuit pump 14 to thereby drive to extend and retract the required hydraulic actuator from among the boom cylinder 1, the arm cylinder 3, and the bucket cylinder 5. The selector valve 45*d* is made to serve as a closed circuit switching unit for the hydraulic motor, and is configured to switch the feeding of the hydraulic fluid to the swing device 7 connected in a closed circuit-shaped manner to the closed circuit pump 14 to thereby switch the swinging direction of the swing device 7. The selector valves 45*a* to 45*d* are configured to switch between conduction and disconnection of the flow passages 203, 204 according to the manipulate signal output from the control device 57, and are disconnected when the manipulate signal is not output from the control device 57. The control device 57 performs control so that the selector valves 45*a* to 45*d* are not to be made conductive at the same time.

The selector valve 45*a* is connected to the boom cylinder 1 through the flow passages 212, 213. The closed circuit pump 14 composes the closed circuit A connected annularly, that is, in a closed circuit-shaped manner, to the boom cylinder 1 through the flow passages 203, 204, the selector valve 45*a*, and the flow passages 212, 213 when the selector valve 45*a* is made conductive according to the manipulate signal output from the control device 57. The selector valve 45*b* is connected to the arm cylinder 3 through the flow passages 214, 215. The closed circuit pump 14 composes the closed circuit B that is connected in a closed circuit-shaped manner to the arm cylinder 3 through the flow passages 203, 204, the selector valve 45*b*, and the flow passages 214, 215 when the selector valve 45*b* is made conductive according to the manipulate signal output from the control device 57.

The selector valve 45*c* is connected to the bucket cylinder 5 through the flow passages 216, 217. The closed circuit pump 14 composes the closed circuit C connected in a closed circuit-shaped manner to the bucket cylinder 5 through the flow passages 203, 204, the selector valve 45*c*, and the flow passages 216, 217 when the selector valve 45*c* is made conductive according to the manipulate signal output from the control device 57. The selector valve 45*d* is connected to the swing device 7 through the flow passages 218, 219. The closed circuit pump 14 composes the closed circuit D that is connected in a closed circuit-shaped manner to the swing device 7 through the flow passages 203, 204, the selector valve 45*d*, and the flow passages 218, 219 when the selector valve 45*d* is made conductive according to the manipulate signal output from the control device 57.

A flow passage 206 is connected to one input and output port of the closed circuit pump 16, and a flow passage 207 is connected to the other input and output port thereof. A plurality of selector valves, for example, four selector valves 47*a* to 47*d* are connected to the flow passages 206, 207. The selector valves 47*a* to 47*c* are made to serve as closed circuit switching units that switch the feeding of the hydraulic fluid to the boom cylinder 1, the arm cylinder 3, and the bucket cylinder 5 that are connected in a closed circuit-shaped manner to the closed circuit pump 16 to thereby drive to extend and retract the required hydraulic actuator from among the boom cylinder 1, the arm cylinder 3, and the bucket cylinder 5. The selector valve 47*d* is made to serve as a closed circuit switching unit for the hydraulic motor, and is configured to switch the feeding of the hydraulic fluid to the swing device 7 connected in a closed circuit-shaped manner to the closed circuit pump 16 to thereby switch the swinging direction of the swing device 7. The selector valves 47*a* to 47*d* are configured to switch between conduction and disconnection of the flow passages 206, 207 according to the manipulate signal output from the control device 57, and are disconnected when the manipulate signal is not output from the control device 57. The control device 57 performs control so that the selector valves 47*a* to 47*d* are not to be made conductive at the same time.

The selector valve 47*a* is connected to the boom cylinder 1 through the flow passages 212, 213. The closed circuit pump 16 composes the closed circuit A that is connected in a closed circuit-shaped manner to the boom cylinder 1 through the flow passages 206, 207, the selector valve 47*a*, and the flow passages 212, 213 when the selector valve 47*a* is made conductive according to the manipulate signal output from the control device 57. The selector valve 47*b* is connected to the arm cylinder 3 through the flow passages 214, 215. The closed circuit pump 16 composes the closed circuit B that is connected in a closed circuit-shaped manner to the arm cylinder 3 through the flow passages 206, 207, the selector valve 47*b*, and the flow passages 214, 215 when the selector valve 47*b* is made conductive according to the manipulate signal output from the control device 57.

The selector valve 47*c* is connected to the bucket cylinder 5 through the flow passages 216, 217. The closed circuit pump 16 composes the closed circuit C that is connected in a closed circuit-shaped manner to the bucket cylinder 5 through the flow passages 206, 207, the selector valve 47*c*, and the flow passages 216, 217 when the selector valve 47*c* is made conductive according to the manipulate signal output from the control valve 57. The selector valve 47*d* is connected to the swing device 7 through the flow passages 218, 219. The closed circuit pump 16 composes the closed circuit D that is connected in a closed circuit-shaped manner to the swing device 7 through the flow passages 206, 207, the selector valve 47*d*, and the flow passages 218, 219 when the selector valve 47*d* is made conductive according to the manipulate signal output from the control device 57.

A flow passage 209 is connected to one input and output port of the closed circuit pump 18, and a flow passage 210 is connected to the other input and output port thereof. A plurality of selector valves, for example, four selector valves 49*a* to 49*d* are connected to the flow passages 209, 210. The selector valves 49*a* to 49*c* are made to serve as closed circuit switching units that switch the feeding of the hydraulic fluid to the boom cylinder 1, the arm cylinder 3, and the bucket cylinder 5 that are connected in a closed circuit-shaped manner to the closed circuit pump 18 to thereby drive to extend and retract the required hydraulic actuator from among the boom cylinder 1, the arm cylinder 3, and the bucket cylinder 5. The selector valve 49*d* is made to serve as a closed circuit switching unit for the hydraulic motor, and is configured to switch the feeding of the hydraulic fluid to the swing device 7 connected in a closed circuit-shaped manner to the closed circuit pump 18 to thereby switch the swinging direction of the swing device 7. The selector valves 49*a* to 49*d* are configured to switch between conduction and disconnection of the flow passages 209, 210 according to the manipulate signal output from the control device 57, and are disconnected when the manipulate signal is not output from the control device 57. The control device 57 performs control so that the selector valves 49*a* to 49*d* are not to be made conductive at the same time.

The selector valve 49*a* is connected to the boom cylinder 1 through the flow passages 212, 213. The closed circuit pump 18 composes the closed circuit A connected in a closed circuit-shaped manner to the boom cylinder 1 through the flow passages 209, 210, the selector valve 49*a*, and the flow passages 212, 213 when the selector valve 49*a* is made conductive according to the manipulate signal output from the control device 57. The selector valve 49*b* is connected to the arm cylinder 3 through the flow passages 214, 215. The closed circuit pump 18 composes the closed circuit B that is connected in a closed circuit-shaped manner to the arm cylinder 3 through the flow passages 209, 210, the selector valve 49*b*, and the flow passages 214, 215 when the selector valve 49*b* is made conductive according to the manipulate signal output from the control device 57.

The selector valve 49*c* is connected to the bucket cylinder 5 through the flow passages 216, 217. The closed circuit pump 18 composes the closed circuit C connected in a closed circuit-shaped manner to the bucket cylinder 5 through the flow passages 209, 210, the selector valve 49*c*, the flow passages 216, 217 when the selector valve 49*c* is made conductive according to the manipulate signal output from the control device 57. The selector valve 49*d* is connected to the swing device 7 through the flow passages 218, 219. The closed circuit pump 18 composes the closed circuit D that is connected in a closed circuit-shaped manner to the swing device 7 through the flow passages 209, 210, the selector valve 49*d*, and the flow passages 218, 219 when the selector valve 49*d* is made conductive according to the manipulate signal output from the control device 57.

A plurality of selector valves, for example four selector valves 44*a* to 44*d*, and a relief valve 21 are connected to one input and output port of the open circuit pump 13 through a flow passage 202. The other input and output port of the open circuit pump 13 is connected to the hydraulic fluid tank 25 to form the open circuit E. The selector valves 44*a* to 44*c* are made to serve as open circuit switching units configured to switch between conduction and disconnection of the flow passage 202 according to the manipulate signal output from the control device 57 to thereby switch a feeding destination of the hydraulic fluid led to flow out of the open circuit pump 13 to coupling flow passages 301 to 304 described later, and are disconnected when the manipulate signal is not output from the control device 57. The control device 57 performs control so that the selector valves 44*a* to 44*d* are not to be made conductive at the same time.

The selector valve 44*a* is connected to the boom cylinder 1 through the coupling flow passage 301 and the flow passage 212. The coupling flow passage 301 is made to serve as a coupling pipe line provided to be branched from the flow passage 212. The selector valve 44*b* is connected to the arm cylinder 3 through the coupling flow passage 302 and the flow passage 214. The coupling flow passage 302 is made to serve as a coupling pipe line provided to be branched from the flow passage 214. The selector valve 44*c* is connected to the bucket cylinder 5 through the coupling flow passage 303 and the flow passage 216. The coupling flow passage 303 is made to serve as a coupling pipe line provided to be branched from the flow passage 216. The selector valve 44*d* is connected, through the coupling flow passage 304 and the flow passage 220, to proportional selector valves 54, 55 as control valves for controlling feeding and discharge of the hydraulic fluid with respect to the travel devices 8*a*, 8*b*. When the hydraulic fluid pressure in the flow passage 202 exceeds the predetermined pressure, the relief valve 21 releases the hydraulic fluid in the flow passage 202 to the hydraulic fluid tank 25 to thereby protect the flow passage, furthermore, the hydraulic driving system 105 (hydraulic circuit).

A bleed-off valve 64 as a second opening and closing device is connected between the flow passage 202 and the hydraulic fluid tank 25. The bleed-off valve 64 is branched from the flow passage 202 for connecting the selector valves 44*a* to 44*d* and the open circuit pump 13 and is connected on the pipe line connected to the hydraulic fluid tank 25. The bleed-off valve 64 controls the flow rate of the hydraulic fluid flowing from the flow passage 202 into the hydraulic fluid tank 25 according to the manipulate signal output from the control device 57. When the manipulate signal is not output from the control device 57, the bleed-off valve 64 is disconnected.

A plurality of selector valves, for example four selector valves 46*a* to 46*d*, and a relief valve 22 are connected to one input and output port of the open circuit pump 15 through a flow passage 205. The other input and output port of the open circuit pump 15 is connected to the hydraulic fluid tank 25 to form the open circuit F. The selector valves 46*a* to 46*d* are made to serve as open circuit switching units that switch between conduction and disconnection of the flow passages 205 according to the manipulate signal output from the control device 57 to thereby switch the feeding destination of the hydraulic fluid led to flow out of the open circuit pump 15 to the coupling flow passages 301 to 304, and are disconnected when the manipulate signal is not output from the control device 57. The control device 57 performs control so that the selector valves 46*a* to 46*d* are not to be made conductive at the same time.

The selector valve 46*a* is connected to the boom cylinder 1 through the coupling flow passage 301 and the flow passage 212. The selector valve 46*b* is connected to the arm cylinder 3 through the coupling flow passage 302 and the flow passage 214. The selector valve 46*c* is connected to the bucket cylinder 5 through the coupling flow passage 303 and the flow passage 216. The selector valve 46*d* is connected to the proportional selector valves 54, 55 through the coupling flow passage 304 and the flow passage 220. On the other hand, when the hydraulic fluid pressure in the flow passage 205 exceeds the predetermined pressure, the relief valve 22 releases the hydraulic fluid in the flow passage 205 to the hydraulic fluid tank 25 to thereby protect the flow passage 205.

A bleed-off valve 65 as a second opening and closing device is connected between the flow passage 205 and the hydraulic fluid tank 25. The bleed-off valve 65 is branched from the flow passage 205 as a pipe line for connecting the selector valves 46*a* to 46*d* and the open circuit pump 15 and is connected on the pipe line connected to the hydraulic fluid tank 25. The bleed-off valve 65 controls the flow rate of the hydraulic fluid flowing from the flow passage 205 into the hydraulic fluid tank 25 according to the manipulate signal output from the control device 57. When the manipulate signal is not output from the control device 57, the bleed-off valve 65 is disconnected.

A plurality of selector valves, for example four selector valves 48*a* to 48*d*, and a relief valve 23 are connected to one input and output port of the open circuit pump 17 through a flow passage 208. The other input and output port of the open circuit pump 17 is connected to the hydraulic fluid tank 25 to form the open circuit G. The selector valves 48*a* to 48*d* are made to serve as open circuit switching units that switch between conduction and disconnection of the flow passages 208 according to the manipulate signal output from the control device 57 to thereby switch the feeding destination of the hydraulic fluid led to flow out of the open circuit pump 17 to the coupling flow passages 301 to 304, and are disconnected when the manipulate signal is not output from the control device 57. The control device 57 performs control so that the selector valves 48*a* to 48*d* are not to be made conductive at the same time.

The selector valve 48*a* is connected to the boom cylinder 1 through the coupling flow passage 301 and the flow passage 212. The selector valve 48*b* is connected to the arm cylinder 3 through the coupling flow passage 302 and the flow passage 214. The selector valve 48*c* is connected to the bucket cylinder 5 through the coupling flow passage 303 and the flow passage 216. The selector valve 48*d* is connected to the proportional selector valves 54, 55 through the coupling flow passage 304 and the flow passage 220. When the hydraulic fluid pressure in the flow passage 208 exceeds the predetermined pressure, the relief valve 23 releases the hydraulic fluid in the flow passage 208 to the hydraulic fluid tank 25 to thereby protect the flow passage 208.

A bleed-off valve 66 as a second opening and closing device is connected between the flow passage 208 and the hydraulic fluid tank 25. The bleed-off valve 66 is branched from the flow passage 208 as a pipe line for connecting the selector valves 48*a* to 48*d* and the open circuit pump 17 and is connected on the pipe line connected to the hydraulic fluid tank 25. The bleed-off valve 66 controls the flow rate of the hydraulic fluid flowing from the flow passage 208 into the hydraulic fluid tank 25 according to the manipulate signal output from the control device 57. When the manipulate signal is not output from the control device 57, the bleed-off valve 66 is disconnected.

A plurality of selector valves, for example four selector valves 50*a* to 50*d*, and a relief valve 24 are connected to one input and output port of the open circuit pump 19 through a flow passage 211. The other input and output port of the open circuit pump 19 is connected to the hydraulic fluid tank 25 to form the open circuit H. The selector valves 50*a* to 50*c* are made to serve as open circuit switching units that switch between conduction and disconnection of the flow passages 211 according to the manipulate signal output from the control device 57 to thereby switch the feeding destination of the hydraulic fluid led to flow out of the open circuit pump 19 to the coupling flow passages 301 to 304, and are disconnected when the manipulate signal is not output from the control device 57. The control device 57 performs control so that the selector valves 50*a* to 50*d* are not to be made conductive at the same time.

The selector valve 50*a* is connected to the boom cylinder 1 through the coupling flow passage 301 and the flow passage 212. The selector valve 50*b* is connected to the arm cylinder 3 through the coupling flow passage 302 and the flow passage 214. The selector valve 50*c* is connected to the bucket cylinder 5 through the coupling flow passage 303 and the flow passage 216. The selector valve 50*d* is connected to the proportional selector valves 54, 55 through the coupling flow passage 304 and the flow passage 220. When the hydraulic fluid pressure in the flow passage 211 exceeds the predetermined pressure, the relief valve 24 releases the hydraulic fluid in the flow passage 211 to the hydraulic fluid tank 25 to thereby protect the flow passage 211.

The selector valves 44*a* to 44*d*, 46*a* to 46*d*, 48*a* to 48*d*, 50*a* to 50*d* are configured to function as the first opening and closing devices for controlling the feeding of the hydraulic fluid from the open circuits E to H to the closed circuits A to D and branching of the hydraulic fluid from the closed circuits A to D to the open circuits E to H.

A bleed-off valve 67 as a second opening and closing device is connected between the flow passage 211 and the hydraulic fluid tank 25. The bleed-off valve 67 is branched from the flow passage 211 as a pipe line for connecting the selector valves 50*a* to 50*d* and the open circuit pump 19 and is connected on the pipe line connected to the hydraulic fluid tank 25. The bleed-off valve 67 controls the flow rate of the hydraulic fluid flowing from the flow passage 211 into the hydraulic fluid tank 25 according to the manipulate signal output from the control device 57. When the manipulate signal is not output from the control device 57, the bleed-off valve 67 is disconnected.

The coupling flow passage 301 is composed of open circuit connecting flow passages 305*a* to 308*a* connected to the discharge side of the hydraulic fluid of at least one of the selector valves 44*a*, 46*a*, 48*a*, 50*a* of the plurality of open circuits E to H, and a closed circuit connecting flow passage 309*a* connected to the flow passage 212 composing the closed circuit A. The coupling flow passage 302 is composed of open circuit connecting flow passages 305*b* to 308*b* connected to the discharge side of the hydraulic fluid of at least one of the selector valves 44*b*, 46*b*, 48*b*, 50*b* of the plurality of open circuits E to H, and a closed circuit connecting flow passage 309*b* connected to the flow passage 214 composing the closed circuit B. The coupling flow passage 303 is composed of open circuit connecting flow passages 305*c* to 308*c* connected to the discharge side of the hydraulic fluid of at least one of the selector valves 44*c*, 46*c*, 48*c*, 50*c* of the plurality of open circuits E to H, and a closed circuit connecting flow passage 309*c* connected to the flow passage 216 composing the closed circuit C. The flow passage 304 is composed of opening circuit connecting flow passages 305*d* to 308*d* connected to the discharge side of the hydraulic fluid of at least one of the selector valves 44*d*, 46*d*, 48*d*, 50*d* of the plurality of open circuits E to H, and a connecting flow passage 309*d* connected to the flow passage 220.

In the hydraulic driving system 105, the closed circuit pumps 12, 14, 16, 18, the boom cylinder 1, the arm cylinder 3, the bucket cylinder 5, and the swing device 7, are composed of the closed circuits A to D that are connected in the closed circuit-shaped manner from the one inlet and outlet port of each of the closed circuit pumps 12, 14, 16, 18 to the other inlet and outlet port through the hydraulic actuator, and further the open circuit pumps 13, 15, 17, 19 and the selector valves 44*a* to 44*d*, 46*a* to 46*d*, 48*a* to 48*d*, 50*a* to 50*d*, are composed of the open circuits E to H with the selector valves 44*a* to 44*d*, 46*a* to 46*d*, 48*a* to 48*d*, 50*a* to 50*d* connected to the output ports of the open circuit pumps 13, 15, 17, 19 and with the hydraulic fluid tank 25 connected to the input port of each of the open circuit pumps 13, 15, 17, 19. As to the closed circuits A to D and the open circuit E to H, for example, four pairs of circuits are provided.

A delivery port of a charge pump 11 is connected to a charging relief valve 20 and charging check valves 26 to 29, 40*a*, 40*b*, 41*a*, 41*b*, 42*a*, 42*b* through a flow passage 229. A suction port of the charge pump 11 is connected to the hydraulic fluid tank 25. The charging relief valve 20 adjusts charge pressure of the charging check valves 26 to 29, 40*a*, 40*b*, 41*a*, 41*b*, 42*a*, 42*b*.

When the hydraulic fluid pressure in the flow passages 200, 201 is lower than pressure set by the charging relief valve 20, the charging check valve 26 feeds the hydraulic fluid from the charge pump 11 to the flow passages 200, 201. When the hydraulic fluid pressure in the flow passages 203, 204 is lower than the pressure set by the charging relief valve 20, the charging check valve 27 feeds the hydraulic fluid from the charge pump 11 to the flow passages 203, 204. When the hydraulic fluid pressure in the flow passages 206, 207 is lower than the pressure set by the charging relief valve 20, the charging check valve 28 feeds the hydraulic fluid from the charge pump 11 to the flow passages 206, 207. When the hydraulic fluid pressure in the flow passages 209, 210 is lower than the pressure set by the charging relief valve 20, the charging check valve 29 feeds the hydraulic fluid from the charge pump 11 to the flow passages 209, 210.

When the hydraulic fluid pressure in the flow passages 212, 213 is lower than the pressure set by the charging relief valve 20, the charging check valves 40*a*, 40*b* feed the hydraulic fluid from the charge pump 11 to the flow passages 212, 213. When the hydraulic fluid pressure in the flow passages 214, 215 is lower than the pressure set by the charging relief valve 20, the charging check valves 41*a*, 41*b* feed the hydraulic fluid from the charge pump 11 to the flow passages 214, 215. When the hydraulic fluid pressure in the flow passages 216, 217 is lower than the pressure set by the charging relief valve 20, the charging check valves 42*a*, 42*b* feed the hydraulic fluid from the charge pump 11 to the flow passages 216, 217.

A pair of relief valves 30*a*, 30*b* is connected between the flow passages 200, 201. When the hydraulic fluid pressure in the flow passages 200, 201 exceeds the predetermined pressure, the relief valves 30*a*, 30*b* release the hydraulic fluid in the flow passages 200, 201 to the hydraulic fluid tank 25 through the charging relief valve 20 to thereby protect the flow passages 200, 201. In the same way, a pair of relief valves 31*a*, 31*b* is connected between the flow passages 203, 204. When the hydraulic fluid pressure in the flow passages 203, 204 exceeds the predetermined pressure, the relief valves 31*a*, 31*b* release the hydraulic fluid in the flow passages 203, 204 to the hydraulic fluid tank 25 through the charging relief valve 20 to thereby protect the flow passages 203, 204.

A pair of relief valves 32*a*, 32*b* is connected also between the flow passages 206, 207. When the hydraulic fluid pressure in the flow passages 206, 207 exceeds the predetermined pressure, the relief valves 32*a*, 32*b* release the hydraulic fluid in the flow passages 206, 207 to the hydraulic fluid tank 25 through the charging relief valve 20 to thereby protect the flow passages 206, 207. A pair of relief valves 33*a*, 33*b* is connected also between the flow passages 209, 210. When the hydraulic fluid pressure in the flow passages 209, 210 exceeds the predetermined pressure, the relief valves 33*a*, 33*b* release the hydraulic fluid in the flow passages 209, 210 to the hydraulic fluid tank 25 through the charging relief valve 20 to thereby protect the flow passages 209, 210.

The flow passage 212 is connected to the head chamber 1*a* of the boom cylinder 1. The flow passage 213 is connected to the rod chamber 1*b* of the boom cylinder 1. A pair of relief valves 37*a*, 37*b* is connected between the flow passages 212, 213. When the hydraulic fluid pressure in the flow passages 212, 213 exceeds the predetermined pressure, the relief valves 37*a*, 37*b* release the hydraulic fluid in the flow passages 212, 213 to the hydraulic fluid tank 25 through the charging relief valve 20 to thereby protect the flow passages 212, 213. A flushing valve 34 is connected between the flow passages 212, 213. The flushing valve 34 discharges the excess hydraulic fluid (excess oil) in the flow passages 212, 213 to the hydraulic fluid tank 25 through the charging relief valve 20.

The flow passage 214 is connected to the head chamber 3*a* of the arm cylinder 3. The flow passage 215 is connected to the rod chamber 3*b* of the arm cylinder 3. A pair of relief valves 38*a*, 38*b* is connected between the flow passages 214, 215. When the hydraulic fluid pressure in the flow passages 214, 215 exceeds the predetermined pressure, the relief valves 38*a*, 38*b* release the hydraulic fluid in the flow passages 214, 215 to the hydraulic fluid tank 25 through the charging relief valve 20 to thereby protect the flow passages 214, 215. A flushing valve 35 is connected between the flow passages 214, 215. The flushing valve 35 discharges the excess hydraulic fluid in the flow passages 214, 215 to the hydraulic fluid tank 25 through the charging relief valve 20.

The flow passage 216 is connected to the head chamber 5*a* of the bucket cylinder 5. The flow passage 217 is connected to the rod chamber 5*b* of the bucket cylinder 5. A pair of relief valves 39*a*, 39*b* is connected between the flow passages 216, 217. When the hydraulic fluid pressure in the flow passages 216, 217 exceeds the predetermined pressure, the relief valves 39*a*, 39*b* release the hydraulic fluid in the flow passages 216, 217 to the hydraulic fluid tank 25 through the charging relief valve 20 to thereby protect the flow passages 216, 217. A flushing valve 36 is connected between the flow passages 216, 217. The flushing valve 36 discharges the excess hydraulic fluid in the flow passages 216, 217 to the hydraulic fluid tank 25 through the charging relief valve 20.

The flow passages 218, 219 are respectively connected to the swing device 7. A pair of relief valves 51*a*, 51*b* is connected between the flow passages 218, 219. When a difference in the hydraulic fluid pressure (a difference in flow passage pressure) between the flow passages 218, 219 exceeds the predetermined pressure, the relief valves 51*a*, 51*b* release the hydraulic fluid in the flow passages 218, 219 on a high pressure side to the flow passages 219, 218 on a low pressure side to thereby protect the flow passages 218, 219.

The proportional selector valve 54 and the travel device 8*a* are connected to each other through the flow passages 221, 222. Relief valves 52*a*, 52*b* are connected between the flow passages 221, 222. When a difference in the hydraulic fluid pressure between the flow passages 221, 222 exceeds the predetermined pressure, the relieve valves 52*a*, 52*b* release the hydraulic fluid in the flow passages 221, 222 on a high pressure side to the flow passages 222, 221 on a low pressure side to thereby protect the flow passages 221, 222. The proportional selector valve 54 is configured to regulate a flow rate so that a connecting destination of the flow passage 220 and the hydraulic fluid tank 25 is switched to either of the flow passage 221 and the flow passage 222 according to the manipulate signal output from the control device 57.

The proportional selector valve 55 and the travel device 8*b* are connected to each other through the flow passages 223, 224. Relief valves 53*a*, 53*b* are connected between the flow passages 223, 224. When a difference in the hydraulic fluid pressure between the flow passages 223, 224 exceeds the predetermined pressure, the relieve valves 53*a*, 53*b* release the hydraulic fluid in the flow passages 223, 224 on a high pressure side to the flow passages 224, 223 on a low pressure side to thereby protect the flow passages 223, 224. The proportional selector valve 55 is configured to regulate the flow rate so that the connecting destination of the flow passage 220 and the hydraulic fluid tank 25 is switched to either of the flow passage 223 and the flow passage 224 according to the manipulate signal output from the control device 57.

The control device 57 controls the regulators 12*a* to 19*a*, the selector valves 43*a* to 50*a*, 43*b* to 50*b*, 43*c* to 50*c*, 43*d* to 50*d*, and the proportional selector valves 54, 55 based on command values of an extension and retraction direction and an extension and retraction speed of each of the boom cylinder 1, the arm cylinder 3 and the bucket cylinder 5, command values of a rotational direction and a rotational speed of each of the swing device 7 and the travel devices 8*a*, 8*b*, that are output from the control lever device 56, and information on various sensors in the hydraulic driving system 105.

Specifically, for example, the control device 57 performs control over a ratio of a pressure receiving area, for controlling a first flow rate and a second flow rate, in order to set a ratio between the first flow rate and the second flow rate to a predetermined value. The first flow rate is a flow rate of the closed circuit pump 12 on the side of the flow passage 212 connected to the head chamber 1*a* and the rod chamber 1*b* of the boom cylinder 1. The second flow rate is a flow rate of the open circuit pump 13 connected to the coupling flow passage 301 through the selector valve 44*a*. The predetermined value is previously set according to the pressure receiving area of the head chamber 1*a* and the rod chamber 1*b* of the boom cylinder 1. In the same way, the control device 57 performs the control over the ratio of the pressure receiving area with respect to the arm cylinder 3 and the bucket cylinder 5 other than the boom cylinder 1.

When at least one or more cylinders of the boom cylinder 1, the arm cylinder 3, and the bucket cylinder 5 are actuated, the control device 57 appropriately controls the selector valves 43*a* to 50*a*, 43*b* to 50*b*, 43*c* to 50*c*, 43*d* to 50*d* so that the hydraulic fluid delivered from the same number of closed circuit pumps 12, 14, 16, 18 as the corresponding open circuit pumps 13, 15, 17, 19 is fed to at least one or more cylinders of the actuating boom cylinder 1, arm cylinder 3 and bucket cylinder 5.

The control lever 56*a* of the control lever device 56 provides the command values of the extension and retraction direction and the extension and retraction speed of the boom cylinder 1 to the control device 57. The control lever 56*b* provides the command values of the extension and retraction direction and the extension and retraction speed of the arm cylinder 3 to the control device 57, and the control lever 56*c* provides the command values of the extension and retraction direction and the extension and retraction speed of the bucket cylinder 5 to the control device 57. The control lever 56*d* provides the command values of the rotational direction and the rotational speed of the swing device 7 to the control device 57. Note that a control lever (not shown) is also provided for providing the command values of the rotational direction and the rotational speed of the travel devices 8*a*, 8*b* to the control device 57.

<Structure of Substantial Part>

Figure 3:
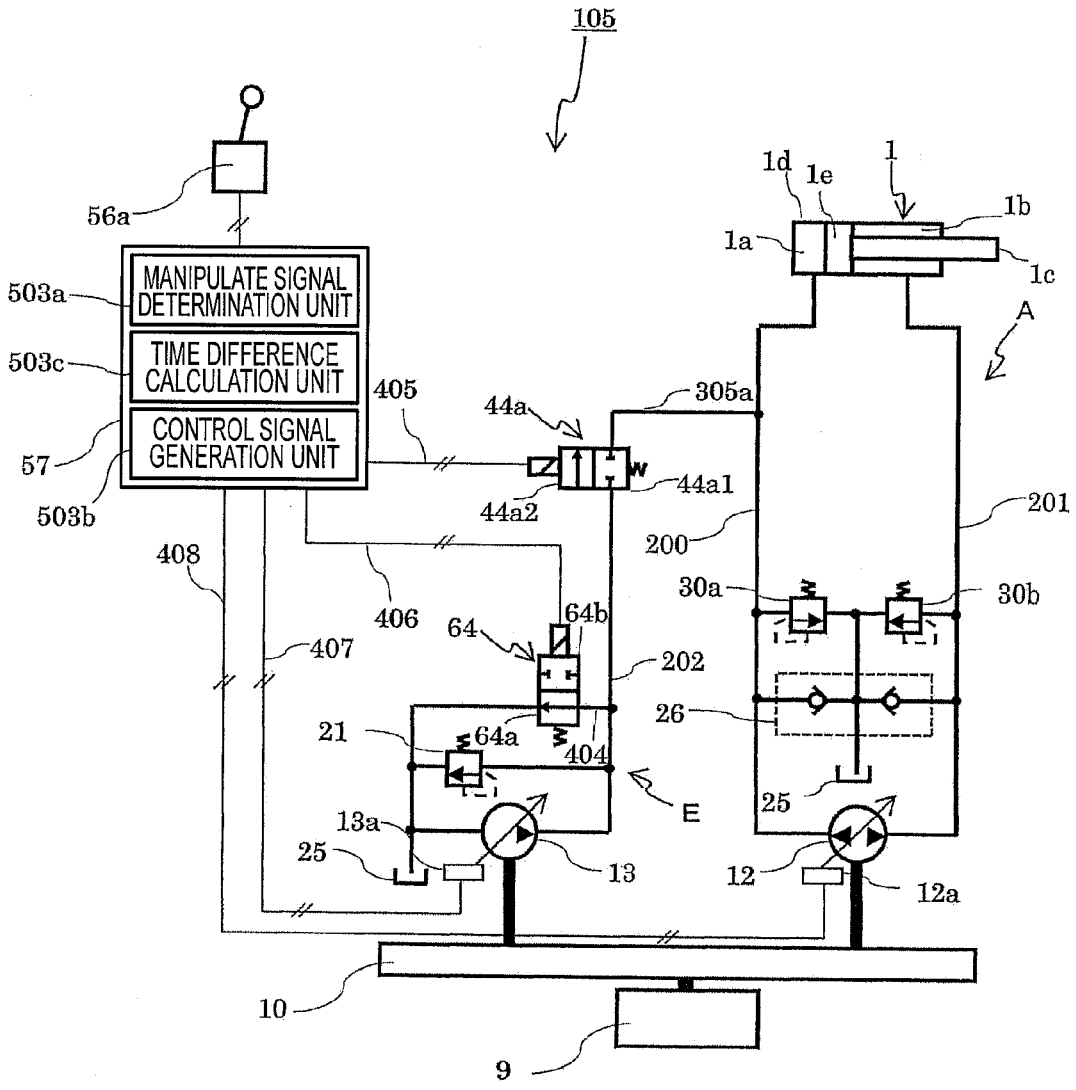
FIG. 3 is a schematic view showing a structure of a substantial part of the hydraulic driving system.

FIG. 3 is a schematic view showing a structure of a substantial part of the hydraulic driving system 105. That is, FIG. 3 is a hydraulic circuit diagram with the substantial part of the hydraulic circuit according to the first embodiment extracted from FIG. 2. Note that in FIG. 3, although the circuit of the boom cylinder 1 is extracted from FIG. 2 and illustrated, the circuits of the other arm cylinder 3 and bucket cylinder 5 have the same structure. In FIG. 3, the same reference signs are used for the structure already described, and the explanation thereof is omitted.

The hydraulic driving system 105 includes the closed circuit A configured in such a manner that the boom cylinder 1 and the closed circuit pump 12 are connected in the closed circuit-shaped manner, the open circuit E configured in such a manner that the open circuit pump 13 is connected to the flow passage on the side of the head chamber 1*a* of the boom cylinder 1 through the selector valve 44*a* and the hydraulic fluid led to flow out of the open circuit pump 13 is introduced into the closed circuit A, and the control device 57 configured to control driving of the closed circuit pump 12 and the open circuit pump 13. The boom cylinder 1 is extended in such a manner that by control over the selector valve 44*a* and the bleed-off valve 64, the hydraulic fluid delivered from the closed circuit pump 12 and the hydraulic fluid delivered from the open circuit pump 13 are merged with each other and are subsequently fed to the side of the head chamber 1*a*. A discharge flow passage 404 as a second flow passage made to serve as a circuit for discharging the hydraulic fluid to the hydraulic fluid tank 25 is provided on the side of the open circuit pump 13. When the boom cylinder 1 is retracted, by the control over the selector valve 44*a* and the bleed-off valve 64, the hydraulic fluid led to flow out of the head chamber 1*a* of the boom cylinder 1 is branched into the side of the closed circuit pump 12 and the discharge flow passage 404 on the side of the open circuit E.

(Control Device)

The control device 57 controls operation of the closed circuit pump 12, the open circuit pump 13, the selector valve 44*a*, and the bleed-off valve 64 according to manipulation of the control lever 56*a*. The control device 57 controls the opening and closing of the selector valve 44*a* through a control signal wire 405 as a first control signal wire, and controls the opening and closing of the bleed-off valve 64 through a control signal wire 406 as a second control signal wire. The control device 57 controls the regulator 12*a* of the closed circuit pump 12 through a control signal wire 408, and controls the discharge flow rate of the closed circuit pump 12 and the direction thereof. Also, the control device 57 controls a regulator 13*a* of the open circuit pump 13 through a control signal wire 407, and controls the discharge flow rate from the open circuit pump 13.

The control device 57 is provided with a manipulate signal determination unit 503*a*, a control signal generation unit 503*b*, and a time difference calculation unit 503*c*. The manipulate signal determination unit 503*a* calculates a target discharge flow rate from each of the closed circuit pump 12 and the open circuit pump 13 in order to extend and retract the boom cylinder 1 according to the manipulated variable of the control lever 56*a* when receiving from the control lever 56*a* operation to extend and retract the boom cylinder 1. The control signal generation unit 503*b* transmits a control signal to the bleed-off valve 64 through the control signal wire 406, and also transmits a control signal to the selector valve 44*a* through the control signal wire 405. The time difference calculation unit 503*c* calculates extension control timing dT1 and retraction control timing dT2, as a time difference from output of the control signal to the bleed-off valve 64 to output of the control signal to the selector valve 44*a*.

(Closed Circuit)

The flow passages 200, 201 are respectively connected to the two input and output ports of the closed circuit pump 12, the head chamber 1*a* of the boom cylinder 1 is connected to the one input and output port of the closed circuit pump 12 through the flow passage 200, and the rod chamber 1*b* of the boom cylinder 1 is connected to the other input and output port of the closed circuit pump 12 through the flow passage 201. The extension and retraction direction (elongation/contraction) of the boom cylinder 1 is dependent on the delivering direction of the hydraulic fluid from the closed circuit pump 12, the hydraulic fluid pressure in each of the head chamber 1*a* and the rod chamber 1*b* of the boom cylinder 1 acts on each of pressure receiving surfaces on the side of the head chamber 1*a* and the side of the rod chamber 1*b* of the piston 1*e* of the boom cylinder 1, and the piston 1*e* receives a load from each of the head chamber 1*a* and the rod chamber 1*b*. A difference in the load acting on the piston 1*e* becomes driving force to drive the piston 1*e*.

(Open Circuit)

The output port of the open circuit pump 13 is connected to the flow passage 202 as the first flow passage, and the input port of the open circuit pump 13 is connected to the hydraulic fluid tank 25. The selector valve 44*a* is provided in the flow passage 202, and the flow passage 202 is connected to the flow passage 200 through the flow passage 305*a*. The discharge flow passage 404 as the second flow passage for returning the hydraulic fluid led to flow out of the outlet port of the open circuit pump 13 to the hydraulic fluid tank 25 is divergingly connected to the flow passage 202, and the discharge flow passage 404 is connected to the hydraulic fluid tank 25. The bleed-off valve 64 is provided in the discharge flow passage 404. The bleed-off valve 64 is made to serve as a two position selector valve having an open position 64*a* and a closed position 64*b* as switching positions. The bleed-off valve 64 is configured to discharge the hydraulic fluid led to flow into the flow passage 202 to the hydraulic fluid tank 25 if necessary, and the switching positions thereof are controlled by the control device 57 through the control signal wire 406.

The bleed-off valve 64 is opened when the switching position of the bleed-off valve 64 is switched to the open position 64*a* by the manipulate signal output from the control device 57. At this time, the hydraulic fluid delivered from the open circuit pump 13 is discharged to the hydraulic fluid tank 25 through the flow passage 404 and the bleed-off valve 64. The bleed-off valve 64 is closed when the switching position of the bleed-off valve 64 is switched to the closed position 64*b* by the manipulate signal output from the control device 57, thereby shutting down passage of the hydraulic fluid from the flow passage 404 to the hydraulic fluid tank 25.

<Action>

Figures 4A, 4B, 4C, 4D, 4E:
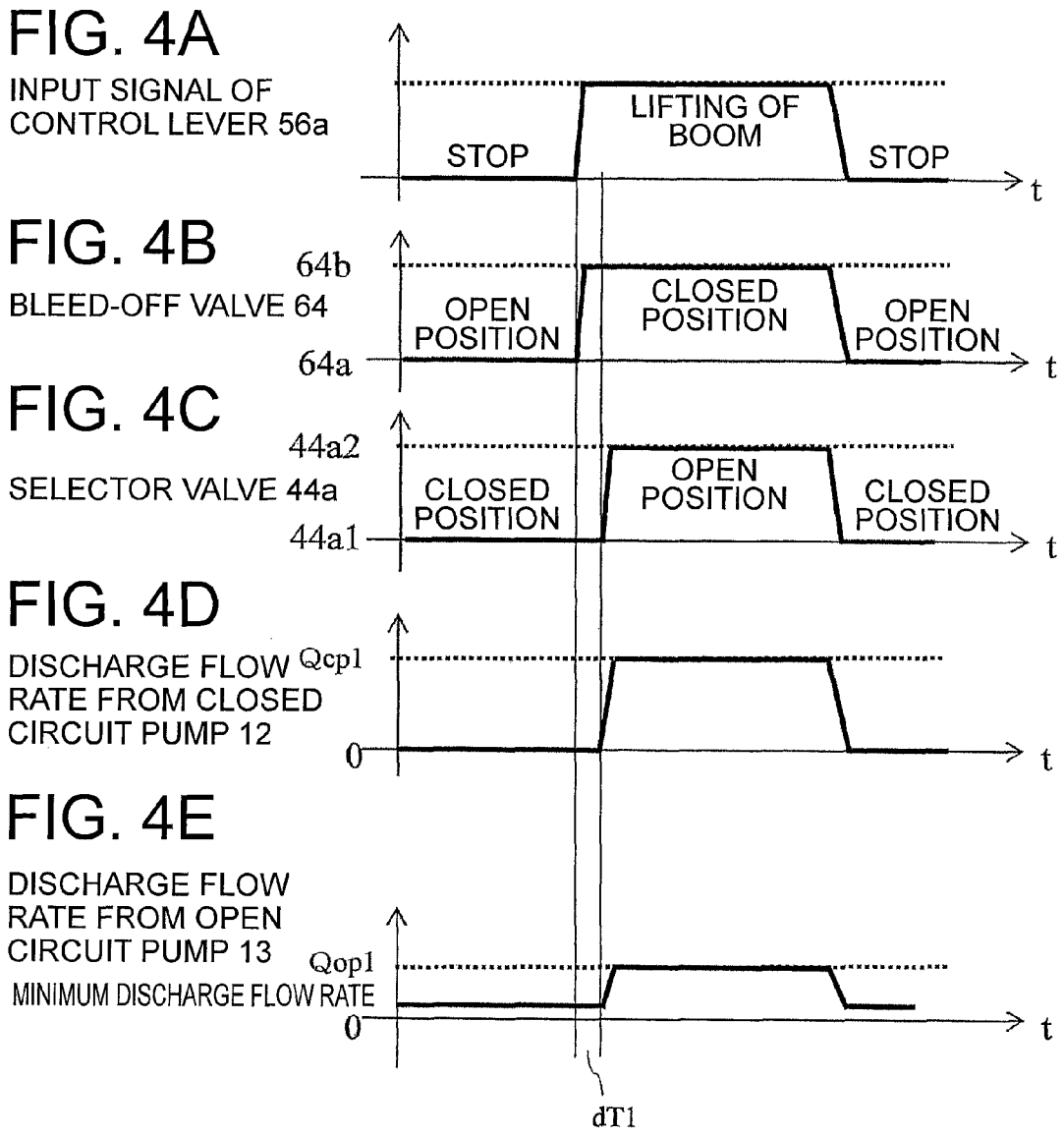

Next, action of the hydraulic driving system 105 according to the above-described first embodiment will be described in relation to the case of actuating the boom cylinder 1 from a stopped state to thereby lift and lower the boom. FIG. 4A to FIG. 4E are time charts showing a state when the boom of the hydraulic driving system 105 is lifted, wherein FIG. 4A is indicative of the input signal of the control lever 56*a*, FIG. 4B is indicative of a state of the bleed-off valve 64, FIG. 4C is indicative of a state of the selector valve 44*a*, FIG. 4D is indicative of the discharge flow rate from the closed circuit pump 12, and FIG. 4E is indicative of a discharge flow rate from the open circuit pump 13.

(During Stopping)

When the control lever 56*a* is not manipulated, the selector valve 44*a* is set in a closed position 44*a*1 through the control signal wire 405 by the control device 57, and the bleed-off valve 64 is set in the open position 64*a* through the control signal wire 406. At this time, the control device 57 outputs the control signal through the control signal wire 408, and controls the regulator 12*a* so that the discharge flow rate from the closed circuit pump 12 is reduced to zero. At the same time, the control device 57 outputs the control signal through the control signal wire 407, and controls the regulator 13*a* so that the discharge flow rate from the open circuit pump 13 is minimized.

The open circuit pump 13 delivers the hydraulic fluid to the flow passage 202, and discharges the hydraulic fluid to the hydraulic fluid tank 25 through the bleed-off valve 64 and the discharge flow passage 404. Now, therefore, the hydraulic fluid is not led to flow into and out of the boom cylinder 1, and the boom cylinder 1 is held in the stopped state.

(Lifting of Boom)

When manipulation to extend the boom cylinder 1 is performed by the control lever 56*a*, the control signal is output from the control device 57 through the control signal wire 406, and the bleed-off valve 64 is controlled in the closed position 64*b*. At this time, the control device 57 outputs the control signal to the regulator 13*a* through the control signal wire 407, and controls the swash plate of the open circuit pump 13 to the minimum tilt, and the open circuit pump 13 delivers the hydraulic fluid of the minimum discharge flow rate to the flow passage 202.

The control device 57 outputs the control signal to set the bleed-off valve 64 in the closed position 64*b*, and subsequently outputs the control signal to set the selector valve 44*a* in an open position 44*a*2 through the control signal wire 405 after lapse of the extension control timing dT1 shown in FIG. 4A to FIG. 4E. At the same time, the control device 57 outputs the control signal to the regulator 13*a* so that the open circuit pump 13 delivers a flow rate Qop1. The selector valve 44*a* is set in an open position 44*a*2 by receiving the control signal, so that the hydraulic fluid delivered from the open circuit pump 13 is merged into the flow passage 200. As a method for setting the extension control timing dT1, a method is given as one example, the method experimentally determining time required to reach holding pressure of the boom cylinder 1 generated in the flow passage 305*a*, that is, pressure with no boom cylinder 1 driven. Also, the extension control timing dT1 may be computationally calculated from the minimum discharge flow rate from the open circuit pump 13, volume of the flow passage 202, and the like. The retraction control timing dT2 described later is calculated in the same manner. Note that, in FIG. 4A to FIG. 4E, control is performed so that the selector valve 44 is set in the open position 44*a*2, and at the same time, the open circuit pump 13 delivers the hydraulic fluid of the flow rate Qop1. However, timing with the control performed to deliver the hydraulic fluid of the flow rate Qop1 by the open circuit pump 13 may be the timing during the extension control timing dT1 soon after the bleed-off valve 64 is closed, and may be the timing after the extension control timing dT1, if the timing is in an extent not having an influence on operation to extend the boom cylinder 1.

Also, the control device 57 outputs the control signal to the regulator 12*a* of the closed circuit pump 12 through the control signal wire 408 at the same extension control timing dT1 as that of output of the control signal to the bleed-off valve 64 to thereby control the swash plate of the closed circuit pump 12, and the hydraulic fluid of the flow rate Qcp1 is delivered to the side of the flow passage 200. The hydraulic fluid delivered from each of the closed circuit pump 12 and the open circuit pump 13 is led to flow into the head chamber 1*a* of the boom cylinder 1 to thereby extend the boom cylinder 1. At the same time, the hydraulic fluid led to flow out of the rod chamber 1*b* of the boom cylinder 1 is sucked into the closed circuit pump 12 through the flow passage 201.

(Lowering of Boom)

Figures 5A, 5B, 5C, 5D, 5E:
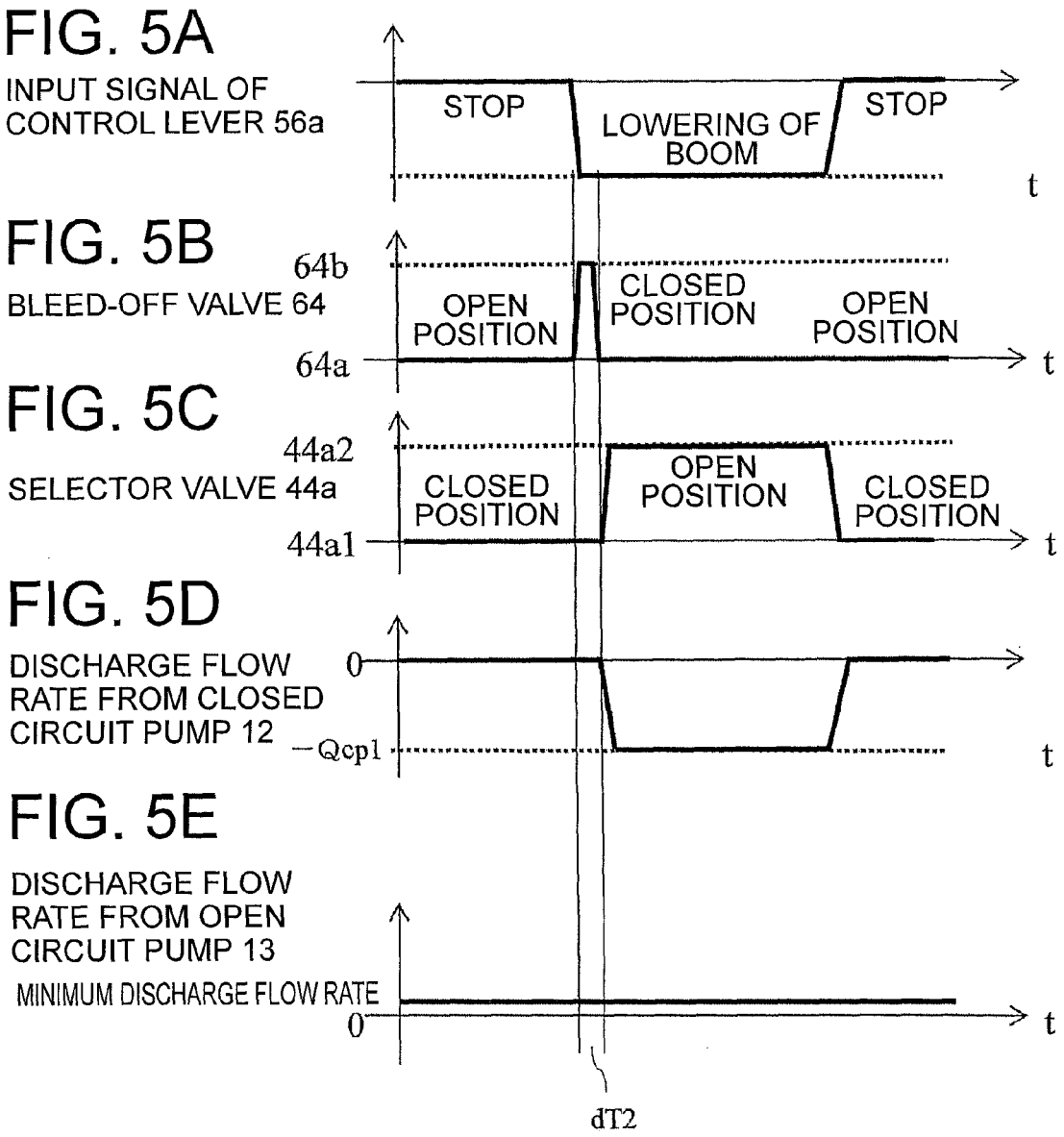

FIG. 5A to FIG. 5E are time charts showing a state when the boom of the hydraulic driving system 105 is lowered, wherein FIG. 5A is indicative of the input signal of the control lever 56*a*, FIG. 5B is indicative of the state of the bleed-off valve 64, FIG. 5C is indicative of the state of the selector valve 44*a*, the FIG. 5D is indicative of the discharge flow rate from the closed circuit pump 12, and FIG. 5E is indicative of the discharge flow rate from the open circuit pump 13.

When the control lever 56*a* is manipulated to retract the boom cylinder 1, the control device 57 outputs the control signal through the control signal wire 406, and controls to set the bleed-off valve 64 in the closed position 64*b*. At this time, the control device 57 controls by outputting the control signal to the regulator 13*a* through the control signal wire 407 so that the open circuit pump 13 delivers the hydraulic fluid of the minimum discharge flow rate. At this time, the control device 57 controls to set the bleed-off valve 64 in the closed position 64*b*; however, since the hydraulic fluid of the minimum discharge flow rate is delivered from the open circuit pump 13 to the flow passage 202, pressure in the flow passage 202 is increased.

The control device 57 outputs the control signal so that the bleed-off valve 64 is set in the closed position 64*b*, and as shown in FIG. 5A to FIG. 5E, subsequently controls to set the bleed-off valve 64 in the open position 64*a* through the control signal wire 405 after lapse of the retraction control timing dT2. At the same time, the control device 57 outputs the control signal to the selector valve 44*a* through the control signal wire 405 so that the selector valve 44*a* is switched from the closed position 44*a*1 to the open position 44*a*2.

Further, the control device 57 outputs the control signal to the regulator 12*a* of the closed circuit pump 12 through the control signal wire 408 to thereby control the swash plate of the closed circuit pump 12, and the hydraulic fluid of the flow rate Qcp1 is delivered to the side of the flow passage 201. In FIG. 5A to FIG. 5E, the discharge flow rate from the closed circuit pump 12 is set to −Qcp1. Note that this means that the closed circuit pump 12 delivers the hydraulic fluid of the flow rate Qcp1 to the side of the flow passage 201 in a direction opposite to the flow passage 200.

The hydraulic fluid delivered from the closed circuit pump 12 is led to flow into the rod chamber 1*b* of the boom cylinder 1 to thereby retract the boom cylinder 1. At the same time, the hydraulic fluid led to flow out of the head chamber 1*a* of the boom cylinder 1 is sucked by the closed circuit pump 12 through the flow passage 200. At this time, the flow rate led to flow out of the head chamber 1*a* is higher than the flow rate led to flow into the rod chamber 1*b* by the difference in the pressure receiving area based on a shape of the rod 1*c* of the boom cylinder 1. For this reason, the excess hydraulic fluid that is not sucked by the closed circuit pump 12 is discharged to the hydraulic fluid tank 25 through the flow passage 305*a*, the selector valve 44*a*, the flow passage 202, the discharge flow passage 404, and bleed-off valve 64.

<Effect>

Figure 6A:
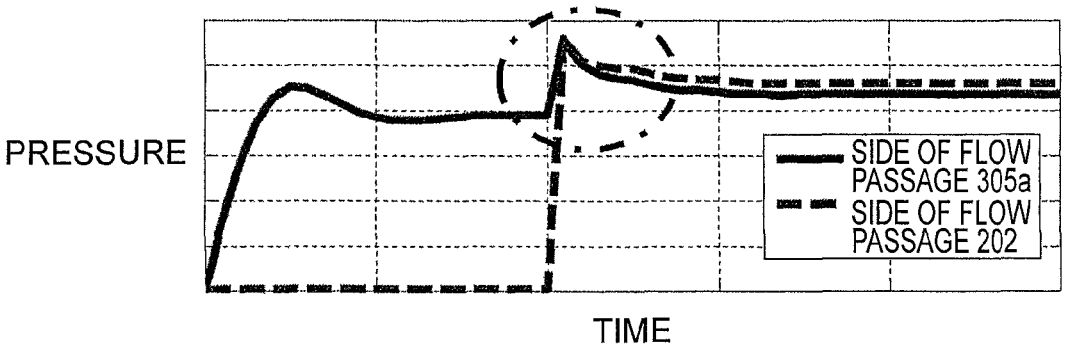
Figure 6B:
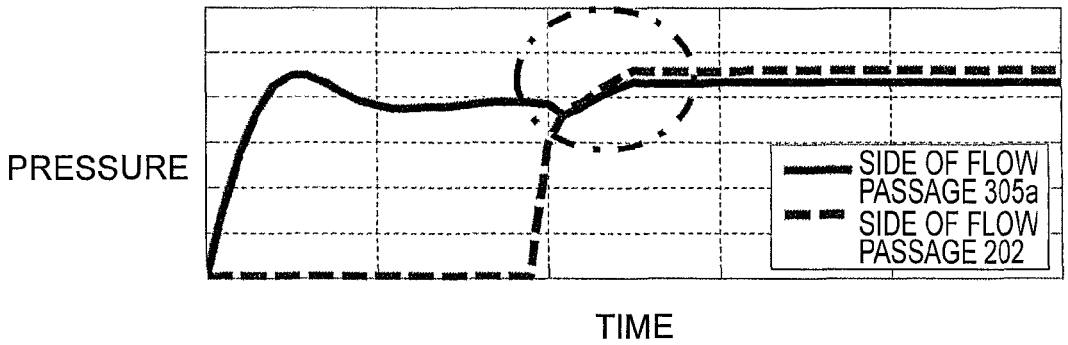

FIG. 6A and FIG. 6B are graphs showing a time-series response of the pressure in the flow passage 202 when the boom of the hydraulic driving system 105 is lifted, wherein FIG. 6A is indicative of the case where there is no extension control timing dT1, and FIG. 6B is indicative of the case where control is performed with the extension control timing dT1.

In the stopped state of the boom cylinder 1, as shown in FIG. 4A to FIG. 4E, the bleed-off valve 64 is controlled to be set in the open position 64*a* so that the hydraulic fluid of the minimum discharge flow rate from the open circuit pump 13 is discharged to the hydraulic fluid tank 25. As a result, the hydraulic fluid pressure in the flow passage 202 is close to zero. On the other hand, self-weight of the arm 4 and the bucket 6, and the load acting on the bucket 6, act on the boom cylinder 1. For this reason, the hydraulic fluid pressure in the head chamber 1*a* of the boom cylinder 1 and the flow passage 305*a* is higher than the hydraulic fluid pressure in the flow passage 202.

(During Lifting of Boom)

As shown in FIG. 6A, if the bleed-off valve 64 is controlled to be set in the closed position 64*b* when, for example, the boom cylinder 1 is extended, and at the same time, the selector valve 44*a* is controlled to be set in the open position 44*a*2, the hydraulic fluid pressure in the flow passage 202 is close to zero, and on the other hand, the hydraulic fluid pressure in the flow passage 305*a* is high. As a result, the hydraulic fluid flows backward from the flow passage 305*a* to the flow passage 202, and the boom cylinder 1 is temporarily retracted. Further, when the boom cylinder 1 is retracted, the hydraulic fluid in the flow passages 202, 305*a* is compressed by the load such as the self-weight acting on the boom cylinder 1. After that, as shown in a dashed-line circle in FIG. 6A, the hydraulic fluid pressure in the flow passages 202, 305*a* is increased by delivery of the hydraulic fluid from the open circuit pump 13, and the inlet-flow rate of the hydraulic fluid into the head chamber 1*a* of the boom cylinder 1 is suddenly changed.

For this reason, in the hydraulic driving system 105 according to the above-described first embodiment, as shown in FIG. 4A to FIG. 4E, the timing for controlling the selector valve 44*a* from the closed position 44*a*1 to the open position 44*a*2 is delayed by the extension control timing dT1 in comparison with the timing for controlling the bleed-off valve 64 from the open position 64*a* to the closed position 64*b*. That is, with returning of the hydraulic fluid from the discharge flow passage 404 to the hydraulic fluid tank 25 shut down, the open circuit pump 13 delivers the hydraulic fluid of the minimum discharge flow rate. Thereby, the hydraulic fluid pressure led to flow out of the open circuit pump 13 is increased in the flow passage 202, the selector valve 44*a* is subsequently opened, and the hydraulic fluid pressure is fed to the head chamber 1*a* of the boom cylinder 1 through the flow passage 305*a* and the flow passage 200. Consequently, as shown in a dashed-line circle in FIG. 6B, the hydraulic fluid pressure in the flow passage 202 is increased, and the difference in pressure between the hydraulic fluid pressure in the flow passage 202 and the hydraulic fluid pressure in the flow passage 305*a* is reduced. In this state, the hydraulic fluid delivered from the closed circuit pump 12 and the hydraulic fluid delivered from the open circuit pump 13 are merged with each other.

In view of this, backward flow of the hydraulic fluid is prevented. The backward flow of the hydraulic fluid is caused by the difference in the pressure between the hydraulic fluids when the hydraulic fluid delivered from the closed circuit pump 12 and the hydraulic fluid delivered from the open circuit pump 13 are merged with each other. As a result, the temporary retraction of the boom cylinder 1 is eliminated, and when extension of the boom cylinder 1 is started, a sudden change in the inlet-flow rate of the hydraulic fluid into the head chamber 1*a* of the boom cylinder 1 is reduced. Accordingly, since extension of the boom cylinder 1 is smoothly started, sufficient startability of the boom cylinder 1 is achieved.

(During Lowering of Boom)

When the boom cylinder 1 is retracted, as a working device disclosed in the above-described International Publication WO 2005/024246, in the case where the check valve is provided in a merging part of the closed circuit and the open circuit, only the closed circuit pump sucks the hydraulic fluid led to flow out of the head chamber 1*a* of the boom cylinder 1 to thereby retract the cylinder of the boom cylinder. On the other hand, in the hydraulic driving system 105 according to the above-described first embodiment, the control device 57 maintains the bleed-off valve 64 to be set in the closed position 64*b* during the retraction control timing dT2, and controls the selector valve 44*a* to be set in the open position 44*a*2 and the bleed-off valve 64 to be set in the open position 64*a* respectively after the hydraulic fluid pressure in the flow passage 202 is increased by delivering the hydraulic fluid of the minimum discharge flow rate by the open circuit pump 13. For this reason, with the difference in pressure between the hydraulic fluid pressure in the flow passage 305*a* and the hydraulic fluid pressure in the flow passage 202 reduced, the hydraulic fluid in the flow passage 305*a* is led to flow to the flow passage 202. Consequently, the hydraulic fluid led to flow out of the head chamber 1*a* of the boom cylinder 1 is smoothly led to flow out in a short time to the hydraulic fluid tank 25 through the flow passage 202 by the hydraulic fluid of the excess flow rate. For this reason, the boom cylinder 1 is retracted at high speed.

Figure 7A:
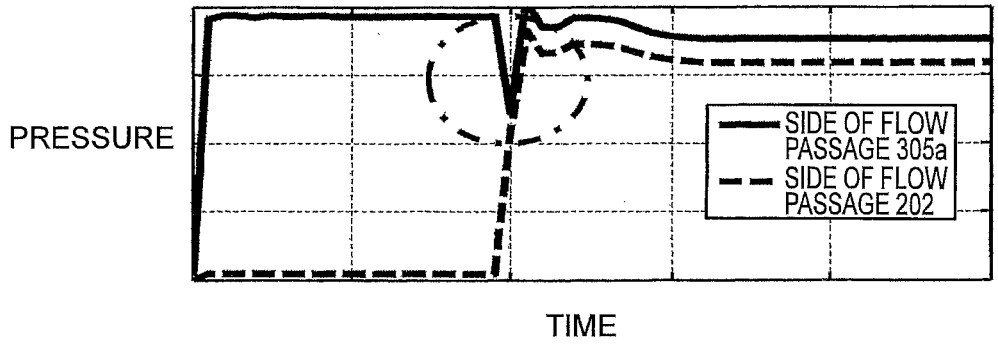
Figure 7B:
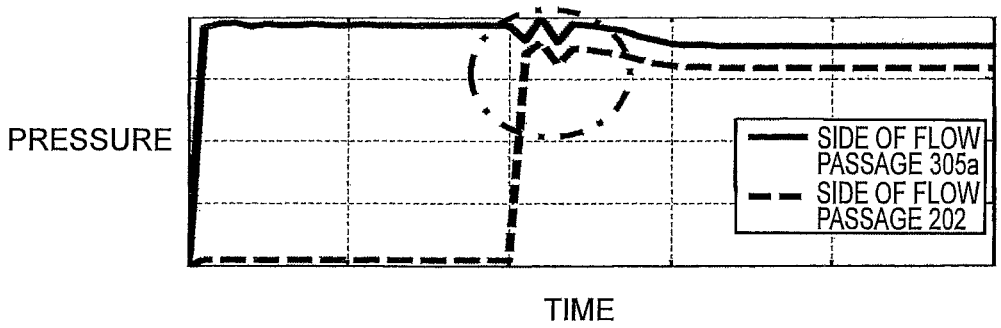

FIG. 7A and FIG. 7B are graphs showing a time-series response of pressure in the flow passage 202 when the boom of the hydraulic driving system 105 is lowered, wherein FIG. 7A is indicative of the case where there is no retraction control timing dT2, and FIG. 7B is indicative of the case where control is performed with the retraction control timing dT2.

First, as shown in FIG. 7A, in the case where when the boom cylinder 1 is retracted, the selector valve 44*a* is controlled to be set in the open position 44*a*2 with the bleed-off valve 64 controlled to be kept in the open position 64*a*, the hydraulic fluid is discharged from the discharge flow passage 404 to the hydraulic fluid tank 25. Thereby, with the hydraulic fluid pressure in the flow passage 202 being close to zero, the flow passage 202 is connected to the high-pressure flow passage 305*a*. As a result, the large amount of hydraulic fluid is temporarily led to flow from the flow passage 305*a* to the flow passage 202. As shown in a dashed-line circle in FIG. 7A, the pressure in the flow passage 305*a* is temporarily reduced, the hydraulic fluid pressure in the head chamber 1*a* of the boom cylinder 1 is reduced, and the boom cylinder 1 is greatly moved in a retraction direction.

For this reason, in the hydraulic driving system 105 according to the above-described first embodiment, as shown in FIG. 5A to FIG. 5E, the timing for once controlling the bleed-off valve 64 to the closed position 64*b* by the retraction timing dT2 and for controlling the bleed-off valve 64 and the selector valve 44*a* to the open positions 64*a*, 44*a*2 is delayed by the retraction timing dT2 after manipulation of the control lever 56*a*. That is, with the returning of the hydraulic fluid from the discharge flow passage 404 to the hydraulic fluid tank 25 shut down, the hydraulic fluid of the minimum discharge flow rate is delivered from the open circuit pump 13, and the hydraulic fluid pressure in the flow passage 202 is increased. After that, the selector valve 44*a* and the bleed-off valve 64 are respectively controlled to be set in the open positions 44*a*2, 64*a*, and the hydraulic fluid (return hydraulic fluid) led to flow out of the head chamber 1*a* of the boom cylinder 1 is led to flow into the flow passage 202. For this reason, as shown in a dashed-line circle in FIG. 7B, the hydraulic fluid pressure in the flow passage 202 is increased, and the difference in the pressure between the hydraulic fluid pressure in the flow passage 202 and the hydraulic fluid pressure in the flow passage 305*a* is reduced. In this state, the flow passage 202 is connected to the flow passage 305*a*.

In view of this, as shown in FIG. 7A, since a sudden flow of the hydraulic fluid in the flow passages 202, 305*a* during connection, caused by the pressure difference, is prevented, the temporary retraction of the boom cylinder 1 is eliminated. For this reason, during the starting of the retraction of the boom cylinder 1, a sudden change in the outlet-flow rate of the hydraulic fluid from the head chamber 1*a* of the boom cylinder 1 is reduced, and the retraction of the boom cylinder 1 is smoothly started. Consequently, the sufficient startability of the boom cylinder 1 is achieved.

[Second Embodiment]

Figure 8:
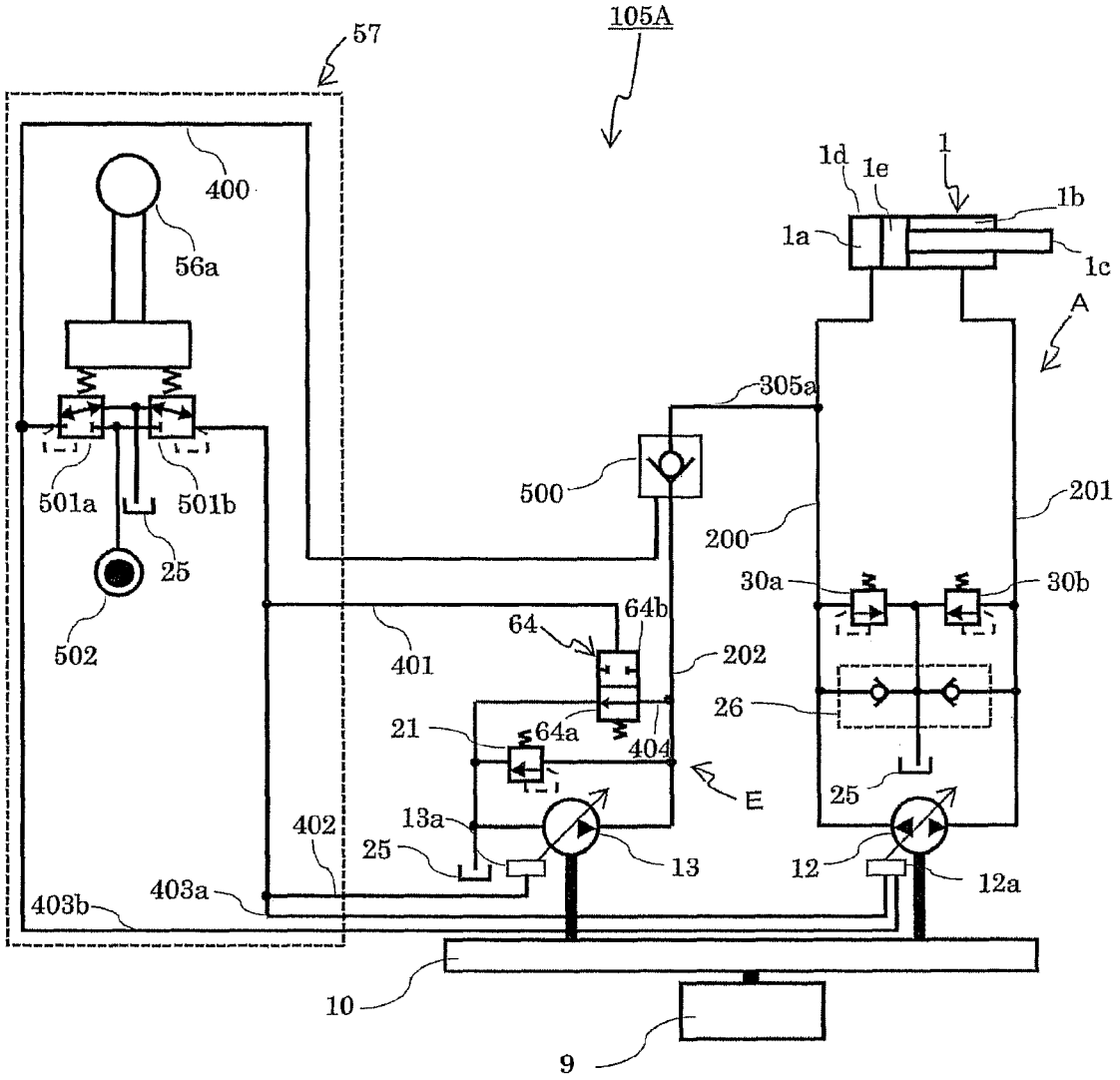
FIG. 8 is a schematic view showing a structure of a substantial part of a hydraulic driving system according to a second embodiment of the present invention.

FIG. 8 is a schematic view showing a structure of a substantial part of a hydraulic driving system 105A according to a second embodiment of the present invention. The second embodiment differ from the aforementioned first embodiment in that in the first embodiment, the hydraulic driving system 105 is configured with the control device 57 made to serve as the electric circuit, and in contrast, in the second embodiment, the hydraulic driving system 105A is configured with the control device 57 including a hydraulic circuit. Note that in the second embodiment, the same reference signs are used for the parts which are the same as or corresponding to those in the first embodiment.

<Structure>

Specifically, in the second embodiment, a pilot check valve 500 as a first opening and closing device is provided in a flow passage 202. The pilot check valve 500 normally allows the hydraulic fluid to flow in one direction from the flow passage 202 to a flow passage 305*a*. When control pressure is applied from the control device 57 to the pilot check valve 500 through a flow passage 400, the pilot check valve 500 cancels a restriction function of a flowing direction of the hydraulic fluid, and allows the flow in a backward direction from the flow passage 305*a* to the flow passage 202.

The control device 57 controls operation of a closed circuit pump 12, an open circuit pump 13, the pilot check valve 500, and a bleed-off valve 64, according to manipulation of a control lever 56*a*, and includes the control lever 56*a*, pressure reducing valves 501*a*, 501*b*, and flow passages 400 to 402, 403*a*, 403*b*. When receiving operation to extend and retract a boom cylinder 1 from the control lever 56*a*, the control device 57 opens the pressure reducing valve 501*a* or the pressure reducing valve 501*b* according to an operation direction thereof, and feeds pressurized oil fed by a pressure feeding source 502 to the flow passages 400 to 402, 403*a*, 403*b* to thereby generate control pressure. That is, when the control lever 56*a* is set in a neutral position, the flow passages 400 to 402, 403*a*, 403*b* are connected to a hydraulic fluid tank 25 through the pressure reducing valve 501*a* and the pressure reducing valve 501*b*, and feeding of the pressurized oil from the pressure feeding source 502 is shut down.

<Action>

Next, action of the hydraulic driving system 105A according to the above-described second embodiment will be described in relation to the case of actuating the boom cylinder 1 from a stopped state to thereby lift and lower a boom.

(During Stopping)

When the control lever 56*a* is not manipulated, the pressure reducing valves 501*a*, 501*b* of the control device 57 are closed, and the flow passages 400 to 402, 403*a*, 403*b* are connected to the hydraulic fluid tank 25.

(Lifting of Boom)

When the control lever 56*a* is manipulated to extend the boom cylinder 1, the pressure reducing valve 501*b* of the control device 57 is opened, the flow passages 401, 402, 403*a* are respectively connected to the pressure feeding source 502, and pressure in the flow passages 401, 402, 403*a* is increased to thereby generate control pressure. At this time, since the pressure reducing valve 501*a* is closed, and the flow passages 400, 403*b* are connected to the hydraulic fluid tank 25, the control pressure is not generated. The bleed-off valve 64 receives the control pressure from the control device 57 through the flow passage 401, and is set in a closed position 64*b* from an open position 64*a*. The control device 57 controls a swash plate of the open circuit pump 13 to a minimum tilt by applying the control pressure to a regulator 13*a* through the flow passage 402, and the open circuit pump 13 delivers the hydraulic fluid of a minimum discharge flow rate to the flow passage 202.

The control device 57 outputs the control pressure to set the bleed-off valve 64 in the closed position 64*b*. After that, when the hydraulic fluid pressure in the flow passage 202 becomes higher than pressure in the flow passage 305*a*, the pilot check valve 500 is opened to thereby feed the hydraulic fluid delivered from the open circuit pump 13 to the flow passage 200. At this time, the extension control timing dT1 shown in FIG. 4A to FIG. 4E is time until the hydraulic fluid pressure in the flow passage 202 becomes higher than the pressure in the flow passage 305*a*.

Also, the control device 57 applies the control pressure to a regulator 12*a* of the closed circuit pump 12 through the flow passage 403*a*, controls the swash plate of the closed circuit pump 12, and delivers the hydraulic fluid of the flow rate Qcp1 to the side of the flow passage 200. At the same time, the control device 57 applied the control pressure to the regulator 13*a* of the open circuit pump 13 through the flow passage 402, controls the swash plate of the open circuit pump 13, and delivers the hydraulic fluid of the flow rate Qop1 to the side of the flow passage 202. The hydraulic fluid delivered from each of the closed circuit pump 12 and the open circuit pump 13 is led to flow into the head chamber 1*a* of the boom cylinder 1 to thereby extend the boom cylinder 1. At the same time, the hydraulic fluid led to flow out of the rod chamber 1*b* of the boom cylinder 1 is fed to the closed circuit pump 12 through the flow passage 201.

<Effect>

(During Lifting of Boom)

Unlike the second embodiment, if the hydraulic fluid delivered from the closed circuit pump 12 and the hydraulic fluid delivered from the open circuit pump 13 are merged with each other not through the pilot check valve 500 with a large pressure difference in the hydraulic fluid pressure between the flow passage 305*a* and the flow passage 202 when for example, the boom cylinder 1 is extended, the hydraulic fluid pressure in the flow passage 202 is close to zero, and on the other hand, the hydraulic fluid pressure in the flow passage 305*a* is high. As a result, the hydraulic fluid flows backward from the flow passage 305*a* to the flow passage 202, and the boom cylinder 1 is temporarily retracted. After that, when the hydraulic fluid pressure in each of the flow passages 202, 305*a* is increased by the hydraulic fluid delivered from the open circuit pump 13, the boom cylinder 1 is suddenly extended, and smooth operation is not achieved.

For this reason, in the hydraulic driving system 105A according to the second embodiment, the bleed-off valve 64 is set in the closed position 64*b* so that the hydraulic fluid pressure in the flow passage 202 is made higher than the pressure in the flow passage 305*a*, and the difference in the pressure between the hydraulic fluid pressure in the flow passage 202 and the hydraulic fluid pressure in the flow passage 305*a* is eliminated. In this state, the hydraulic fluid delivered from the closed circuit pump 12 and the hydraulic fluid delivered from the open circuit pump 13 are merged with each other. Consequently, in the same manner as the hydraulic driving system 105 according to the first embodiment, in the hydraulic driving system 105A, the backward flow of the hydraulic fluid, caused by the pressure difference during merging, is prevented, and temporary retraction of the boom cylinder 1 is eliminated. For this reason, smooth extension of the boom cylinder 1 is started, and sufficient startability of the boom cylinder 1 is achieved.

[Third Embodiment]

Figure 9:
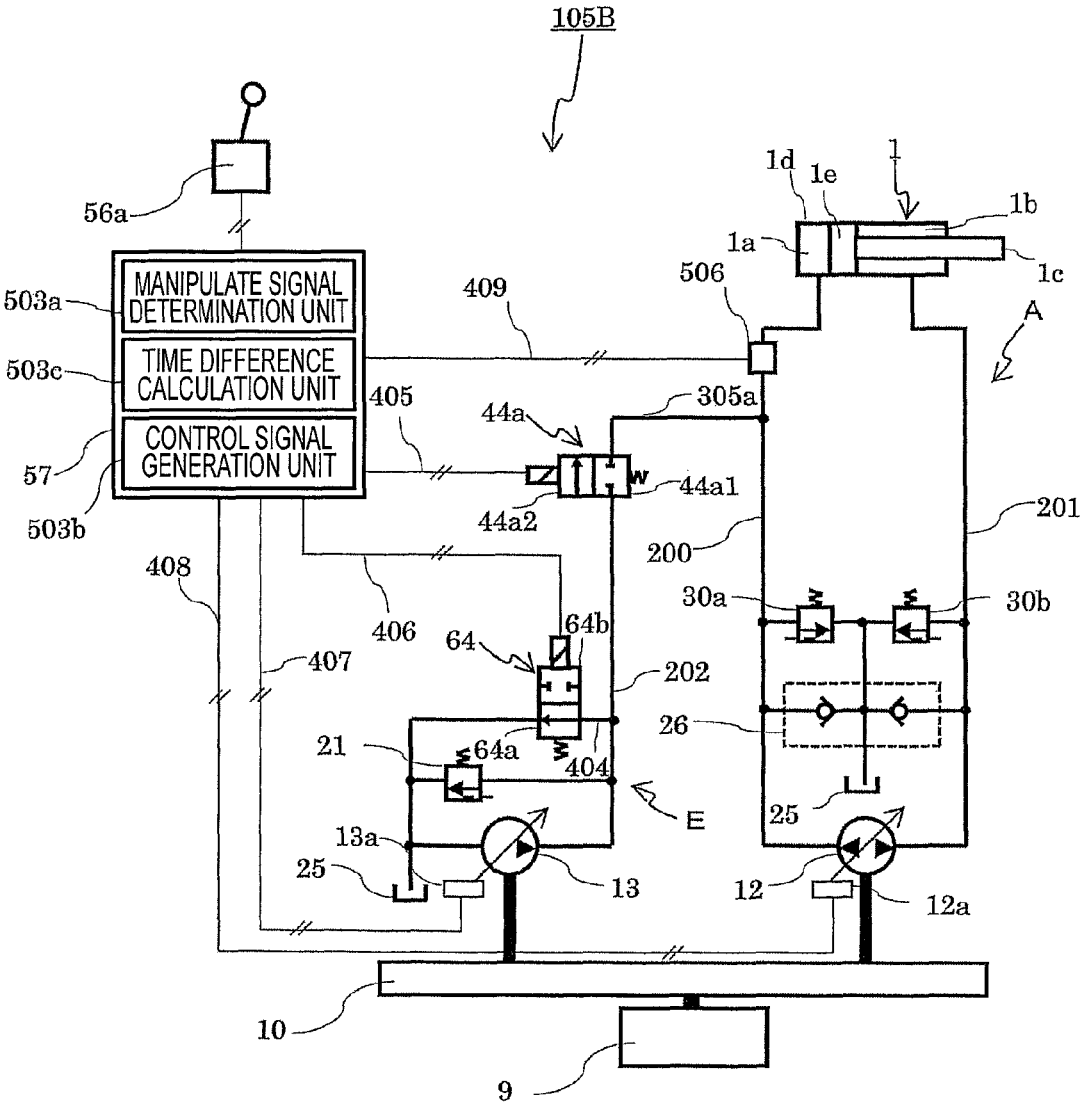
FIG. 9 is a schematic view showing a structure of a substantial part of a hydraulic driving system according to a third embodiment of the present invention.
Figure 10:
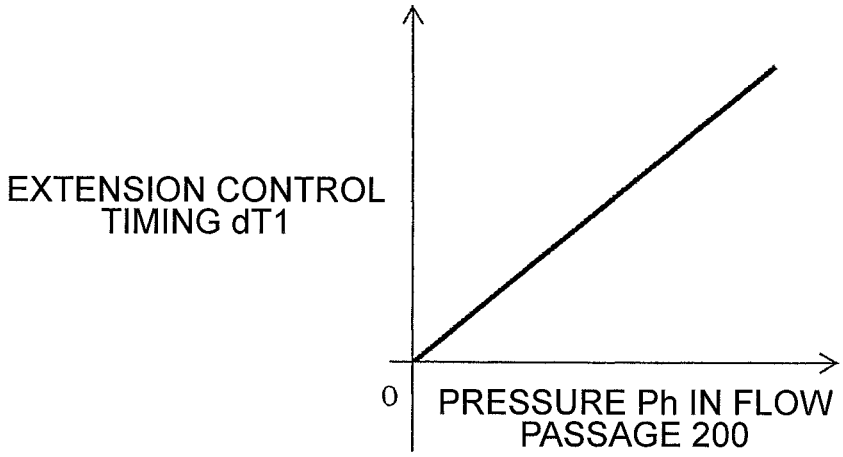
FIG. 10 is a graph showing the extension control timing dT1 with respect to pressure Ph in a closed circuit of a time difference calculation unit of the hydraulic driving system.

FIG. 9 is a schematic view showing a structure of a substantial part of a hydraulic driving system 105B according to a third embodiment of the present invention. FIG. 10 is a graph showing extension control timing dT1 with respect to pressure Ph in a flow passage 200 of a closed circuit A of a time difference calculation unit 503*c* of the hydraulic driving system 105B.

The third embodiment differs from the aforementioned second embodiment in that in the second embodiment, the hydraulic driving system 105A is configured with the control device 57 including the hydraulic circuit, and in contrast, in the third embodiment, the hydraulic driving system 105B is configured with the control device 57 including a function of calculating extension control timing dT1. Note that in the third embodiment, the same reference signs are used for the parts which are the same as or corresponding to those in the second embodiment.

<Structure>

The time difference calculation unit 503*c* of the control device 57 has a function of calculating the extension control timing dT1 based on pressure in a head chamber 1*a* of a boom cylinder 1. A pressure sensor 506 as a pressure sensing device is provided in a flow passage 200, and the pressure sensor 506 and the control device 57 are connected to each other through a pressure signal wire 409. The control device 57 measures hydraulic fluid pressure (pressure Ph) in the head chamber 1*a* of the boom cylinder 1 by the pressure sensor 506, and calculates the extension control timing dT1 based on the pressure Ph by the time difference calculation unit 503*c*.

In general, the pressure Ph in the closed flow passage 200 is proportional to a value of time integration of a flow rate of the hydraulic fluid led to flow into the flow passage 200. That is, when an inlet-flow rate stays constant, time reaching a certain pressure is uniquely determined, and bears a proportional relationship to the pressure Ph. When the extension control timing dT1 is set based on the time reaching the certain pressure, as shown in FIG. 10, the pressure Ph and the extension control timing dT1 have the proportional relationship. With respect to control over opening and closing of a selector valve 44*a*, after lapse of the calculated extension control timing dT1, the opening and closing of the bleed-off valve 64 is controlled through a control signal wire 406. As a result, the extension control timing dT1 is determined, and sufficient startability of the boom cylinder 1 is achieved. The extension control timing dT1 reduces a difference in pressure of hydraulic fluid pressure between the front and rear of the bleed-off valve 64 for acquiring smooth operation when driving the boom cylinder 1 without depending on a magnitude of a load acting on the boom cylinder 1.

<Action>

When a control lever 56*a* is manipulated to extend the boom cylinder 1, the bleed-off valve 64 is set in a closed position 64*b* by receiving a control signal output from the control device 57 through the control signal wire 406. In this state, the control device 57 measures the pressure Ph in the flow passage 200 through a pressure signal wire 409 by the pressure sensor 506. After that, the time difference calculation unit 503*c* of the control device 57 calculates the extension control timing dT1 based on the pressure Ph. As to calculation of the extension control timing dT1, for example, as shown in FIG. 10, the extension control timing dT1 with respect to the pressure Ph is determined based on a predetermined map. Note that in the third embodiment, operation during stopping and operation during lowering of a boom are the same as those in the aforementioned first embodiment.

With the third embodiment, in the same way as the first embodiment, sufficient starting characteristic of the boom cylinder 1 is achieved. In addition, smooth operation is achieved when the boom cylinder 1 is driven without depending on the magnitude of the load acting on the boom cylinder 1. That is, the extension control timing dT1 for reducing the pressure difference between the front and rear of the bleed-off valve 64 without depending on the magnitude of the load acting on the boom cylinder 1 is fluctuated based on the pressure Ph in the flow passage 200. For this reason, sufficient startability of the boom cylinder 1 during extension is achieved.

Also, when the control lever 56*a* is manipulated to retract the boom cylinder 1, for example, in the same manner as the case where the extension control timing dT1 is set based on a map shown in FIG. 10, extension control timing dT2 is set based on the pressure Ph detected by the pressure sensor 506 by the time difference calculation unit 503*c* of the control device 57. For this reason, sufficient startability is achieved also during retraction of the boom cylinder 1.

[Other]

Note that the present invention is not limited to the aforementioned embodiments, and various design changes can be made thereto without departing from the subject matter of the present invention. For example, the aforementioned embodiments have been described for clear and detailed explanation of the present invention, and the present invention is not necessarily limited to those having all the described structures.

Also, in each of the embodiments, although explanation has been given to the case when the boom cylinder 1 is started to extend and retract, the present invention is applicable to other single rod hydraulic cylinders such as the arm cylinder 3 and the bucket cylinder 5. For example, the same pressure difference in the flow passage as the case when the boom is lifted is generated also when the arm cylinder 3 is started to extend. For this reason, the present invention is applicable to the case when the arm cylinder 3 is started to extend and retract.

Further, in each of the embodiments, although the case where the present invention is applied to the hydraulic excavator 100 has been exemplarily described, the present invention is applicable also to construction machines other than the hydraulic excavator 100. For example, the present invention is applicable if the operating machine such as a hydraulic crane and a wheel loader includes at least one or more single rod hydraulic cylinders driven by the working device.

Also, in each of the embodiments, although, as the open circuit pumps 13, 15, 17, 19, the hydraulic pumps are configured to include the unidirectionally tilting swash plate mechanisms that control the flow rate only, the hydraulic pumps including the bidirectionally tilting swash plate mechanisms that control the delivering direction and the flow rate may be used. Also, although the closed circuit pumps and open circuit pumps 12 to 19 are configured to be respectively connected to one engine 9 through the power transmission device 10, such a structure is conceivable that as the closed circuit pumps and open circuit pumps 12 to 19, a plurality of fixed displacement hydraulic pump are prepared, electric motors controlling a rotational direction and a rotational speed are connected to the fixed displacement hydraulic pumps, the electric motors are controlled by the control device 57, and the delivering/inlet-flow direction and the discharge flow rate of the hydraulic fluid are controlled by the rotational direction and the rotational speed of the fixed displacement hydraulic pumps.

Further, in each of the embodiments, the selector valves 44*a* to 44*d*, 46*a* to 46*d*, 48*a* to 48*d*, 50*a* to 50*d*, the proportional selector valves 54, 55, 60, 63, the bleed-off valves 64 to 67 are not only directly controlled by the control signal output from the control device 57 but also may be controlled by the hydraulic signal obtained by converting the control signal output from the control device 57 by the use of a solenoid pressure reducing valve.

What is claimed is:

1. A hydraulic driving system comprising:

a closed circuit pump that has two inlet and outlet ports;

a single rod hydraulic cylinder that has a head chamber and a rod chamber;

an open circuit pump that has an inlet port for allowing hydraulic fluid to flow in from a hydraulic fluid tank and an outlet port for allowing the hydraulic fluid to flow out;

a first flow passage that connects the outlet port of the open circuit pump and the head chamber of the single rod hydraulic cylinder;

a first opening and closing device that is provided in the first flow passage;

a second flow passage that is connected to the first flow passage and returns the hydraulic fluid led to flow out of the outlet port of the open circuit pump to the hydraulic fluid tank;

a second opening and closing device that is provided in the second flow passage;

an operating device that outputs a command signal of extension and retraction of the single rod hydraulic cylinder corresponding to manipulation by an operator; and a control device that controls the closed circuit pump, the open circuit pump, the first opening and closing device, and the second opening and closing device based on the command signal outputted by the operating device, wherein the control device includes a control signal generation unit that outputs a control signal to the first opening and closing device and the second opening and closing device, and a time difference calculation unit that calculates a time difference from a time when the control signal generation unit outputs a control signal to the second opening and closing device until a time when the control signal generation unit outputs a control signal to the first opening and closing device, and wherein when an operation for extending the single rod hydraulic cylinder is performed, the control signal generation unit outputs the control signal so as to close the second opening and closing device in a state in which the open circuit pump is outflowing the hydraulic fluid, and the control signal generation unit outputs the control signal so as to open the first opening and closing device after the time calculated by the time difference calculation unit has elapsed.

2. The hydraulic driving system according to claim 1, wherein the control device is configured in such a manner that when an operation for retracting the single rod hydraulic cylinder is performed, the second opening and closing device is closed temporarily, next the first and second opening and closing devices are respectively opened, and the closed circuit pump is subsequently controlled.

3. The hydraulic driving system according to claim 2, further comprising:

a pressure sensor for detecting the pressure of the hydraulic fluid in the head chamber, wherein the time difference calculation unit calculates the time difference based on the pressure of the hydraulic fluid in the head chamber detected by the pressure sensor.

4. The hydraulic driving system according to claim 1, wherein the first opening and closing device is opened when pressure of the hydraulic fluid in a circuit between the first opening and closing device and the open circuit pump is higher than pressure of the hydraulic fluid introduced into the head chamber of the single rod hydraulic cylinder.

* * * * *